US005853537A

United States Patent [19]

Blanchette et al.

[11] Patent Number: 5,853,537

[45] **Date of Patent: *Dec. 29, 1998**

[54] PROCESS FOR TREATING PULPWOODS AND PULPS WITH A PITCH DEGRADING FUNGUS OF THE GENUS OPHIOSTOMA

[75] Inventors: Robert A. Blanchette, Shoreview, Minn.; Roberta L. Farrell, Danvers, Mass.; Yitzhak Hadar, Rehovot, Israel; Johnnie E. Merritt, II; Robert A. Snyder, both of Ashland, Va.; Philip A. Wendler, Belmont; Wendy Zimmerman, Newton, both of Mass.

[73] Assignee: Clariant Finance (BVI) Limited, Tortola, Virgin Islands (Br.)

[ * ] Notice: The term of this patent shall not extend beyond the expiration date of Pat. No. 5,476,789.

[21] Appl. No.: 465,638

[22] Filed: Jun. 5, 1995

Related U.S. Application Data

[63] Continuation of Ser. No. 188,371, Jan. 26, 1994, abandoned, which is a continuation of Ser. No. 891,620, Jun. 1, 1992, abandoned, which is a continuation of Ser. No. 566,940, Aug. 13, 1990, abandoned, which is a continuation-in-part of Ser. No. 310,814, Feb. 13, 1989, abandoned.

[51] Int. Cl.[6] ..... C12N 1/14; D21H 25/02

[52] U.S. Cl. ..... 162/72; 435/277; 435/278; 435/911; 162/DIG. 3

[58] Field of Search ..... 162/72, DIG. 4; 435/243, 254.1, 254.11, 267, 277, 278, 911

[56] References Cited

U.S. PATENT DOCUMENTS

| | | | |
|---|---|---|---|
| 3,401,085 | 9/1968 | Croon et al. . | |
| 3,486,969 | 12/1969 | Nilsson et al. | 162/72 |
| 4,687,741 | 8/1987 | Farrell et al. | 162/72 |
| 5,096,824 | 3/1992 | Seifert et al. | 435/254 |
| 5,476,789 | 12/1995 | Farrel et al. | 162/72 |

FOREIGN PATENT DOCUMENTS

| | | |
|---|---|---|
| 49-92301 | 9/1974 | Japan . |
| 58-180692 | 10/1983 | Japan . |
| 1189604 | 4/1970 | United Kingdom . |

OTHER PUBLICATIONS

Jurasek et al, "Pulp, Paper, and Biotechnology", *Chemtech,* Jun. 1986, pp. 360–365.

Resin Maturation In Chip Piles and Its Effects on the Sulfite and Sulfate Industries, by Ingemar Croon, U.S. Dept. of Agriculture Forest Service, Washington, D.C., Nov. 1965, pp. 1–17.

Characteristics of Sulphite and Kraft Pulps From Blue–Stained Southern Pine, by G.H. Chidester et al., Technical Assoc. Sect., Paper Trade Journal, Apr. 7 1938, pp. 219–222 (Tappi Section).

Deterioration of Southern Pine Chips (During Summer & Winter Storage by Joseph R. Saucier et al., Forest Products Journal, pp. 371–379, Aug. 1961.

Precise Studies on the Effect of Outside Chip Storage on Fiber Yield: White Spruce and Lodgepole Pine, by J.V. Hatton, Tappi, vol. 53, No. 4, Apr. 1970, pp. 627–638.

Effect of Prolonged Outside Chip Storage on Yield and Quality of Kraft Pulps From *Picea glauca* and *Pinus contorta* Chips, by John V. Hatton et al., Tappi, vol. 55, No. 1, Jan. 1972, pp. 122–126.

The Effect of Outside Chip Storage on the Extractives of White Spruce and Lodgepole Pine, by I.H. Rogers, et al., Pulp and Paper Magazine of Canada, pp. 84–90, vol. 72, No. 6, Jun. 1971.

Deterioration of Softwood Chips Owing to Outside Storage in New Brunswick, by J.K. Shields, et al., Pulp and Paper Magazine of Canada, Nov. 1, 1968, pp. 62–67.

The Effects of Outside Storage on Slash Pine Chips in the South, by C.W. Rothrock, Jr., et al., Tappi, vol. 44, No. 1, Jan. 1961, pp. 65–73.

Forest Pathology, J.S. Boyce, 3rd Ed. McGraw–Hill Book Co., 1961, pp. 493–512, Chapter 20: "Deterioration of Forest Products: Stains".

"Outside Chip Storage (OCS)", Assarsson, A., et al. pp. 493–501, Nr 16, Aug. 31, 1970.

Principles of Fermentation Technology, Stanbury, P.F., et al., Pergamon Press, 1984, Chapter 3: The Isolation, Preservation and Improvement of Industrial Microorganisms, pp. 26–30 & 232–233.

Overproduction of Microbial Metabolites, Strain Improvement and Process Control Strategies, Vojtisek, V., et al., 1986, Chapter 9: Selection and Enrichment of Active Strains of Microorganisms and Their Use for Production of Immobilized Cell Biocatalysts, pp. 183–186.

*Primary Examiner*—Steven Alvo
*Attorney, Agent, or Firm*—Hesna J. Pfeiffer

[57] ABSTRACT

Wood-penetrating fungi of the classes Ascomycotina and Deuteromycotina may be used very effectively to degrade pitch in wood forms used in the making of cellulosic products. Such fungi include but are not limited to the blue stain fungi. The process of Ascospore selection may be used to provide fungi which exhibit good growth on wood substrate while having little or no effects on substrate brightness, or even a positive effect on brightness. The treatment positively influences strength properties of ultimate products such as paper. In one embodiment the pulpwood or pulp is treated with a pitch degrading fungus of the genus Ophiostoma.

69 Claims, No Drawings

PROCESS FOR TREATING PULPWOODS AND PULPS WITH A PITCH DEGRADING FUNGUS OF THE GENUS OPHIOSTOMA

This is a continuation of application Ser. No. 08/188,371, filed Jan. 26, 1994 , which in turn is a continuation of application Ser. No. 07/891,620, filed Jun. 1, 1992 , which in turn is a continuation of application Ser. No. 07/566,940, filed Aug. 13, 1990, which in turn is a continuation-in-part of application Ser. No. 07/310,814, filed Feb. 13, 1989, all of which are now abandoned.

BACKGROUND OF THE INVENTION

Outdoor storage of wood, particularly in the form of stockpiled wood chips, is a major activity in the pulp and paper industry for the purpose of maintaining a convenient and economical feed source.

The industry has therefore long been concerned with the effect on pulp recovery and paper quality of the seasoning which occurs in such wood during outdoor storage prior to mechanical and/or chemical pulping. More particularly, there has been interest in evaluating the effects of fungal presence on pulpwood and cellulosic products prepared therefrom.

In one aspect, it has been observed that under certain conditions, pulp yield and paper quality may be compromised by certain degradative processes associated with fungal infection, such as by brown-rot fungi. In another aspect, the gradual breakdown of the resinous component, which has been attributed to oxidative and other chemical reactions and also in part to microbial action, may facilitate the subsequent mechanical and/or chemical processing of the pulp.

The resins or wood pitch present in wood used for pulping, that is not otherwise recovered as a valuable by-product, can be a serious problem in the pulp and paper industry, causing relatively frequent and lengthy periods of down-time for cleaning, particularly in mechanical pulp processes, and other drawbacks.

The wood chip pile or other large accumulations of refined wood raw material, typically stored outside while awaiting entry into the primary pulping operation, are well studied in the literature and carefully observed and managed in practical operation. Such accumulations are subject to all sorts of influences including weather, dust, microorganisms such as fungi and bacteria, insects, etc. Seasonal variations in performance of the chips in pulping, including reduction in problems involving pitch, have long been observed, and associated with different factors by different observers, including aging and such associated factors as microbial action. The natural aging which takes place in a chip pile has therefore been accepted and practised within certain limits and with reservations, and the use of at least a portion of chips from aged cut timber in making up a chip pile has been practiced although the practice of aging timber tends to be inconvenient and costly.

Nilsson, et al., U.S. Pat. No. 3,486,969, discloses that certain fungi can be used to inoculate wood chips to reduce the resin content of the chips and pulp made therefrom, while minimizing degradation of the cellulose or hemicellulose components of the wood. To our knowledge, no such process has achieved commercial recognition and the fungal species specifically disclosed therein are apparently all mold type or surface forming fungi which, when discoloring the wood, produce essentially a surface or superficial stain that can be readily planed off (see J. S. Boyce, Forest Pathology, Third Edition, 1961, McGraw-Hill Book Company, Chapter 20, pages 493–512, particularly pages 496–497). Certain such fungi have been also characterized as soft rot fungi.

Among the fungi infecting wood chip piles to varying extents in most if not all parts of the world are those commonly classified as stains, including those known as blue-stains and other dark stains. By definition, these fungi darkly stain the chip and have been of serious concern in the production of paper, particularly but not limited to color influence. While many studies over the years have indicated that wood-penetrating, blue-stains do not really adversely affect paper production or quality (perhaps requiring only an adjustment in brightening or bleaching in the more severe cases when quality white paper is produced), the dark stains and particularly the blue-stains have remained essentially a concerned nuisance, and more particularly a negative factor resulting from the aging of pulpwoods. For example, the appearance of blue-stain fungi in a wood chip pile is generally localized, but is subject to spreading, particularly in warm weather. When the outer surfaces of the wood chip pile indicate the potential for substantial spreading prior to the scheduled use of the chips, wood chip pile managers have even been known to take away portions of the infected chips and place them in unaffected piles simply to reduce the perceived impact of the stain on the paper-making process.

SUMMARY OF THE INVENTION

It has now been found in accordance with the present invention that wood-penetrating fungi, commonly represented by and including particularly but not limited to dark or blue-stain fungi, may be used very effectively to degrade pitch in wood forms for use in papermaking and other pulpwood-consuming industries, and thereby substantially reduce the problems and inefficiencies created by pitch in such processes. It has also been found that among such wood-penetrating, pitch-grading fungi, there can be provided those which also degrade pitch but have less or substantially no coloring effect on the wood substrate, and in particular that the technique of ascospore selection can provide fungi which very effectively degrade pitch while causing less coloring effect than their parent fungi on non-sterile substrates, or little or substantially no coloring effect, or even a positive coloring effect.

Accordingly, the present invention in a preferred embodiment comprises a process for pretreating refined pulpwood to at least partially degrade the resin component thereof by applying to the pulpwood an inoculum of a wood-penetrating, pitch-degrading fungus to provide an inoculated pulpwood, accumulating the inoculated pulpwood in a mass and maintaining the accumulated mass under conditions which promote fungal growth for a time sufficient to effect a reduction of the resin component of the pulpwood by the fungus. The inoculum is obtained from a purified culture of such fungi or from substrates with fungi derived from such inoculum. The invention may also be applied to other resin-containing substrates found in the pulp and paper industries including pulped woods, and in particular to the pulps produced from refined pulpwoods, such as in mechanical and other pulping processes. The invention may be further applied to unrefined pulpwood, eg. cut timber in undebarked or debark form, by inoculating timber or logs, which may be at least partially scored in the case of undebarked timber, and maintaining such unrefined pulpwood for a time sufficient to allow for growth and penetration of the fungus into the pulpwood and a reduction in the pitch content thereof. In general, pulpwood or pulp is inoculated, eg. with a purified culture obtained inoculum of such fungi, and the pulpwood or pulp maintained under conditions to allow growth of the fungus for a time to reduce the pitch content. The invention may be applied to both sterilized and non-sterilized substrates, but it is a particular feature of the invention that non-sterile substrate may be very effectively treated to reduce pitch.

The process of the present invention provides a wood source for and can be employed advantageously in connection with mechanical or chemical pulping processes to reduce the level of resinous substances in the finished pulp and thus prevent equipment clogging and down-time typically caused by the constituents of resin, and similar and other related problems, including concerns created by the chlorinated derivatives of such materials which otherwise may result as by-products of bleaching in chemical pulping procedures. The invention may be applied generally to both sterilized and non-sterile substrates. However, particular and desired benefits are realized when the invention is used with non-sterile pulpwoods. When pulps are treated, most pulp forms will be sterilized as a result of the pulping process.

DETAILED DESCRIPTION OF THE INVENTION

The term "refined pulpwood" is used herein to mean any tree material used in making paper or cardboard or other cellulosic-containing products such as viscose, and obtained as a result of mechanical and/or shearing forces applied to timber, logs or portions thereof to obtain a multiplicity of high surface area, small pieces or particles suitable for introduction into the primary or first pulping stage of any pulping process such as the various mechanical and chemical processes. Wood chips and sawdust represent two common refined pulpwoods. As indicated, the invention may also be applied to treat pulps which have been only incompletely pulped and still contain, for example, 60% or more of the original lignin content, and especially to treat the mechanical pulp which is the product of the primary or first pulping stage of the overall mechanical pulping process.

The term "pulpwood" is used to indicate refined pulpwoods and the unrefined forms such as timber and logs from which the refined pulpwood may be obtained.

By the term "resin" is meant that complex mixture of hydrophobic substances in wood, also commonly known as pitch, which are soluble in neutral organic solvents, such as methylene chloride, diethyl ether, benzyl alcohol and the like. For purposes of this invention, the standard Tappi extraction analysis using methylene chloride will suffice for measuring the reduction in resins which is the object of the invention. These include the terpenes, the diterpene ("resin") acids, fatty acids and esters, glycerides and waxes as well as alcohols, hydrocarbons and other compounds associated therewith. The terms "resin" and "pitch" are used interchangeably herein.

The composition of resin varies among wood species and thus shall be understood to refer to a broad spectrum of hydrocarbon mixtures. As is well known, the amount of resin also varies considerably among different tree types. Resin is generally found in the sapwood portion of trees and also in the heartwood.

Resin is a significant constituent of both softwood, such as southern pine, conifers and cedars, and hardwoods, such as Betula and Populus, and it may comprise as much as 4% weight percent or even more of the feed sent to mechanical or chemical pulping processes, generally 1.5 to 4.0% for many woods used for pulping. Softwoods generally contain more resin than hardwoods, with the pines having among the highest resin content among the softwoods. In the hardwoods, resin is located primarily in the ray parenchyma cells which form much of the fine fiber fraction when wood is pulped. In softwoods, resin is contained in both the ray parenchyma cells and also in resin ducts.

The presence of resin in wood pulp is generally a negative factor which must be dealt with in any wood pulping operation. It may result in the formation of deposits which interfere with paper machine operation, particularly in mechanical pulping processes, and may adversely affect the quality of pulp, and the paper prepared therefrom.

On exposure to moisture in the environment hydrolysis of the glyceride constituent takes place. In addition, oxidation of the saturated components also occurs. These two reactions aid in subsequent removal of the resin in pulp manufacturing. However, components of resin such as waxes which are only partially or not at all degraded by such oxidative or hydrolytic mechanisms or other means generally persist in the pulp, giving rise to problems in mechanical or chemical pulping.

The wood-penetrating, pitch-grading fungi for use in the invention are typically found among the fungal classes Ascomycotina (Ascomyetes) and the Fungi Imperfecti which are Deuteromycotina (Deuteromycetes), and are represented by a wide variety of genera. Such genera includes without limitation genera of the sub-class Ophiostomatales and the imperfect states associated to Ophiostomatales which include Ceratocystis, Ceratocystiopsis, Ophiostoma Graphium, Leptographium, Phialocephala Rhinocladiella, Hyalodendron and Sporothrix. Other such fungi on a limited species basis (not classified as Ophiostomatales or their associated imperfect states) are found among the genera Alternaria, Cadophora, Chloridium, Codinaea, Diplodia, Sphaeropsis, Dactylella, Fusarium, Hormodendron, Hormonema, Phialophora, Trichosporium (Trichosphaeria) and Valsa. The taxonomic limits of the above genera are known to be changeable. As referred to herein, we use the genera in their broadest sense. For the generic concepts of Ophiostoma, Ceratocystis, Ceratocystiopsis, Graphium, Leptographium, Phialocephala and Sporothrix, we use the concepts given by T. C. Harrington, New Combinations in Ophiostoma of Ceratocystis species with Leptographium Anamorphs, Mycotaxon 28: pages 39–43 (1987) and on pages 1–39 of Leptographium Species, Their Distributions, Hosts and Insect Vectors, APS Press, St. Paul, Minn., U.S.A., T. C. Harrington and F. W. Cobb, editors. The concepts of other genera given herein are found in Hawksworth, et al., Ainsworth and Bisby's Dictionary of Fungi, 7th Edition (1988) Commonwealth Mycological Institute, Kew, Surrey, England.

The penetrating fungi which are found among the indicated fungal classes of Ascomycotina and Deuteromycotina and which are useful to degrade pitch in accord with the invention include, as indicated, the dark or blue-stain fungi and also include other fungi which penetrate wood and which do not darkly stain, or for that matter do not appear to stain or color the wood at all. For example, within a preferred genera, Ophiostoma, the fungi, *Ophiostoma nigrocarpum* grows white in color, yet it is indicated to penetrate wood and degrade its pitch content, as indicated by tests on sterilized substrates. Even among the species commonly recognized as including or being represented by blue or dark stain fungi there can be found variants and isolates which are of lighter color, growing in a gray in most any shade from light gray to dark gray. Those growing lighter than a dark or true blue staining fungus we have called "faded" fungi. Such faded fungi, depending on their degree of lightness in color, have less, little or no effect on the color of the wood. While a penetrating dark staining fungus may be preferred from some standpoints, eg. competitive growth in a non-sterile environment, it may not be ideal from the standpoints of its coloring effect on the wood. We have found, as hereinafter indicated, that fungi retaining many or all of desired properties of the dark staining fungi but which grow with at most very little color, eg. light gray or essentially white, may be obtained by ascospore selection, and such faded or light color isolates or variants used to degrade pitch in accord with the invention while imparting essentially no color to the wood. Hence, the present invention includes, for example, not only the penetrating, darker staining fungal species and other penetrating, pitch-degrading species found within the above indicated fungal classes but also all of those isolates, variants and mutants of such species which may vary in one respect or another from the more typical species representatives but have the ability to penetrate wood and degrade pitch in wood.

The penetrating fungus used in the present invention are judged a recognizable type of fungi. Penetrating stain fungi were recognized by Boyce, supra, as causing a deep stain that cannot be readily planed off. Penetrating fungi may also be generally characterized by colonization of the xylary tissues of non-sterile wood, Boyce, supra, pages 499–504. Microscopic analysis indicates that such fungus, after a suitable growth period, are characterized by both invading and depositing color or staining in the ray parenchyma cells and, in the case of at least softwoods, the resin ducts. Hence, the distinction between surface penetrating and the true penetrating fungi of the invention is recognized, and may also be ascertained and in different ways, eg. by close or microscopic examination of cross-sections of unrefined pulpwood, taken in the area of growth (as seen when debarked), and after a reasonable growth at essentially an optimal growth temperature of the fungus. Staining well within the parenchyma cells (and resin ducts in the case of softwoods) is caused by the penetrating fungi. When the penetrating fungi does not visably or darkly stain, its presence may also be observed, eg. by mycelia residue color. In either case, a degradation effect upon the pitch in the cells and ducts may be determined, if needed, by microscopic examination, eg. by SEM (Scanning electron microscopy) confirmed by assaying for pitch reduction by a standard method as indicated herein. Various evaluations may be also made by inoculating and growing the fungus. In general, the suitable fungi will exhibit substantial growth at temperatures in the range of 40° F. to 90° F. and for evaluation purposes a temperature of optimal growth will be selected (such optimal growth temperatures being determined in a routine manner as well known in the art). For such classification purposes, such evaluations may be made, for example, using a debarked pulpwood such as a log with diameter of about 12 inches which is relatively freshly cut and a section which appears uninfected by organisms, and on which the fungus exhibits a natural growth. The fungus is preferably inoculated in a lightly sanded area which appears uninfected by other fungiand wood specimen maintained at the predetermined optimal growth temperature and a constant humidity of about 90% for three weeks or more, depending upon growth rate. Inoculation rate will be increased to high levels with slower growing fungi to expedite evaluation, particularly on non-sterile substrates. Cross sections can then be taken, and the penetrating fungi are generally those in which one or more of three cross-sections show a discoloration or other penetration of fungal growth at least 6 mm or more below the inoculated surface. The preferred such fungi are those which penetrate to a depth considerably greater than 6 mm over three weeks and desirably which on close or microscopic inspection show not only a substantial invasion of parenchyma cells but also a substantial reduction or essentially voiding of the resin content normally found within such cells. For classification purposes, the evaluations are conducted on specimens of a pulpwood which is more commonly subject to natural infection by the fungus to be evaluated. For practical application purposes, in determining the more suitable candidates for a particular wood, such evaluation may be conducted on unrefined specimens of the wood actually proposed to be treated by the fungus to reduce its pitch content.

The invention may be applied to essentially any wood used for making pulp and ultimately paper and paperboard products or other products obtained from wood pulps such as viscose, including both hardwoods and softwoods, including conifers, and a listing which is not limiting includes pines, poplars, spruces, firs (including Douglas firs), oaks, cypresses, larches, yews, tamaracks, tupelo, beech, magnolia, hickory, cedars, maples, elms, birches and many others. Each of the growth classes of angiosperms and gymnosperms may be treated by the invention process to reduce their pitch content.

Within the foregoing genera are typically a number of representative species and varieties and a partial and merely representative list of interesting subjects is given immediately below along with, in some cases, host tree woods commonly infected and locations where they have been found. The identification of the fungus (by "CMW" number) in the following list is not consecutive and should be considered arbitrary since the list is derived from a larger list from which fungi of other classes have been deleted. The list inventories a culture collection at the University of Minnesota under the care of Robert A. Blanchette. The presentation of the list is made essentially to the extent known to Dr. Blanchette and without representation that each and every particular isolate has been heretofore publically identified. Hence, the list is merely given to indicate the extent of penetrating fungal species and/or varieties and their breadth and/or diversity of their location. Representative species from the collection were evaluated for ability to reduce pitch on sterilized, knotless Southern (U.S.) yellow pine wood chips (100 g inoculated with 1 ml. of spore suspension containing $10^7$ spores after growing on malt extract, yeast extract agar plates at 25° C.). The fungus grew on the chips in plastic bags for 2 weeks at room temperature after which the chips were ground into sawdust (after drying overnight at 60° C.) and evaluated relative to control chips which after 2 weeks showed a pitch content of 2.1% except the control was 2.3% when noted by an asterisk below under Pitch Level (%). The Pitch Level of those fungi reducing pitch on the Southern Yellow Pine is noted in the listing below.

| CMW Culture No. | Fungus Identification (and Pitch level) | Host or Source | Location |
|---|---|---|---|
| 2 | *L. penicillatum* (1.8) | | |
| 3 | *L. procerum* (1.5) | White pine | |
| 4 | *L. procerum* | White pine | |
| 5 | *L. procerum* | Ponderosa pine | |
| 6 | *L. abietinum* (1.8) | Ponderosa pine | |
| 7 | L. sp. | Ponderosa pine | |
| 8 | *L. abietinum* | | |
| 10 | *L. procerum* | Austrian pine | |
| 11 | *L. terebrantis* | | |
| 12 | *L. procerum* | White pine | |
| 13 | *L. procerum* | | |

-continued

| CMW Culture No. | Fungus Identification (and Pitch level) | Host or Source | Location |
|---|---|---|---|
| 14 | L. spp. | Maritime pine | |
| 16 | *L. procerum* | Monterey pine | |
| 17 | *L. procerum* | White pine | |
| 18 | *L. procerum* | Monterey pine | |
| 19 | *L. procerum* | White pine | New Zealand |
| 20 | *L. procerum* | White pine | Ontario |
| 21 | *L. truncatum* (1.8) | | New Zealand |
| 22 | L. sp. | Loblolly pine | |
| 23 | *L. procerum* | | |
| 24 | *L. procerum* | | |
| 25 | *L. procerum* | White pine | Yogoslavia |
| 26 | *L. procerum* | Fraser Fir | |
| 27 | *L. procerum* | Jack pine | Minnesota |
| 28 | *L. truncatum* (2.0)* | Loblolly pine | |
| 29 | *L. truncatum* | Loblolly pine | |
| 30 | *L. procerum* | White pine | |
| 31 | *L. procerum* | White pine | New Zealand |
| 32 | *L. abietinum* | Engelman spruce | Victoria Canada |
| 33 | *L. procerum* | White pine | Yogoslavia |
| 34 | *L. procerum* | *Weevil hylobius* | Minnesota |
| 35 | *L. serpens* | — | South Africa |
| 36 | *L. serpens* | — | South Africa |
| 37 | *L. serpens* | Loblolly pine | |
| 38 | *L. procerum* | | |
| 39 | *L. penicillatum* | Ponderosa pine | |
| 40 | *L. wageneri* | | |
| 41 | *L. serpens* | White pine | |
| 44 | *L. serpens* | | |
| 45 | *L. terebrantis* (1.9)* | Scotch pine | Minnesota |
| 46 | *L. procerum* | White pine | |
| 47 | *L. terebrantis* | Bark Beetle | California |
| 48 | *L. lundbergii* | ATCC 2235 | |
| 49 | *L. Wagneri* | | |
| 50 | *L. wagneri* | | |
| 52 | *L. procerum* | | |
| 54 | *L. wagneri* | Douglas Fir | California |
| 56 | *L. procerum* | White pine | Illinois |
| 57 | *L. procerum* | White pine | Pennsylvania |
| 58 | *L. procerum* | Red pine | Minnesota |
| 59 | *L. procerum* | Grand fir | Washington |
| 60 | *L. serpens* | *Pinus pinaster* | South Africa |
| 61 | *C. subanulata* | Ponderosa pine | |
| 62 | *O. microsporum* | | |
| 64 | *O. piliferum* | | |
| 65 | *O. abiocarpum* (1.6) | | |
| 68 | *C. fraxinopennsylvanica* (1.7) | | |
| 69 | *O. piceae* (1.6) | | |
| 70 | *C. coerulescens* | | |
| 71 | *C. adiposa* (1.3) | | |
| 72 | *O. tremulo-aureum* (1.7) | | Minnesota |
| 73 | *O. huntii* (1.9) | | |
| 74 | *O. gossypinum* | | |
| 76 | *O. piliferum* | Ponderosa pine | |
| 77 | *O. populinum* (1.6) | | |
| 79 | *C. virescens* | | |
| 80 | *O. minus* | | |
| 83 | *O. minus* (1.6) | Red pine | Minnesota |
| 84 | *O. ips* | Red pine | Minnesota |
| 85 | *O. piliferum* | | |
| 89 | *C. eucastaneae* | | |
| 91 | *C. californica* | | |
| 93 | *O. minutum* | | |
| 94 | *O. piliferum* | | |
| 96 | *O. galeiformis* | | |
| 97 | *C. tenella* | | |
| 98 | *O. piceae* | | |
| 101 | *O. stenoeras* | | |
| 102 | *O. tremulo-aureum* | | |
| 103 | *O. minus* | | |
| 104 | *O. abiocarpum* | | |
| 106 | *O. brevicollis* | | |
| 107 | *C. ponderosae* | | |
| 108 | *O. pluriannulatum* (1.7) | | |

-continued

| CMW Culture No. | Fungus Identification (and Pitch level) | Host or Source | Location |
|---|---|---|---|
| 109 | *O. huntii* | | |
| 110 | *O. distortum* | | |
| 111 | *C. fraxinopennsylvanica* | | |
| 112 | *C. gossypinum* | | |
| 113 | *O. olivaceum* (1.9) | | |
| 114 | *O. robustum* (2.1)* | | |
| 115 | *O. drydcoetidis* | | |
| 116 | *C. olivaceapini* | | |
| 118 | *C. ambrosa* | | |
| 119 | *C. coerulescens* | | |
| 120 | *O. populinum* | | |
| 121 | *C. adiposa* | | |
| 122 | *L. procerum* | | |
| 123 | *L. penicillatum* | | Vermont |
| 124 | Graphium sp. | Red pine | |
| 125 | *O. ips* | Scots pine | Minnesota |
| 126 | *O. clavigerum* (1.8) | Lodgepole pine | Wyoming |
| 128 | *C. ponderosae* (1.7) | | |
| 129 | *O. Stenoceras* | | |
| 130 | *C. ambrosia* | | |
| 131 | *O. distortum* | | |
| 132 | *C. eucastaneae* | Chestnut canker | |
| 133 | *O. olivaceum* | | |
| 135 | *O. adjuncti* (1.4) | | |
| 136 | *O. galeiformis* | | |
| 138 | *O. robustum* | | |
| 139 | *O. aureum* (1.6) | | |
| 141 | *O. europhioides* | | |
| 143 | *C. californica* | | |
| 144 | *C. tenella* | | |
| 146 | C. denticulata | | |
| 148 | L. sp. from soil | | Minnesota |
| 150 | *C. allantospora* | Red pine | Wisconsin |
| 147 | *O. gossypinum* | | |
| 153 | *O. piceae* | Red oak | Minnesota |
| 154 | *Chloridium virescens* var. *chlamydosporum* (2.1)* | Jack pine | Wisconsin |
| 155 | C. sp. | Jack pine | Wisconsin |
| 157 | Chloridium sp. (1.6)* | Jack pine | Wisconsin |
| 158 | Dactylella sp. | Jack pine | Wisconsin |
| 159 | *O. minus* | Red pine | Wisconsin |
| 160 | *C. tetropii* (1.7) | Red pine | Wisconsin |
| 161 | C. sp. | Jack pine | Wisconsin |
| 162 | Ceratocystiopsis sp. (1.8) | Jack pine | Wisconsin |
| 163 | *C. allanlospora* | Red pine | Wisconsin |
| 165 | Dactylella sp. | White pine weevil | Wisconsin |
| 166 | *Phialocephala bactrospora* | ATCC 44606 | |
| 167 | L. sp. | ATCC 12867 | |
| 168 | *Phialocephala dimorphospora* | ATCC 24087 | |
| 169 | *L. pyrinum* | ATCC 34943 | |
| 171 | *Phialocephala fusca* | Maple | |
| 172 | Phialocephala fusca | | |
| 173 | *O. minus* | *M. scuttellatus* | Wisconsin |
| 174 | *Phialocephalia dimorphospora* (1.7) | | |
| 175 | Codinaea sp. | *Monochamus carolinensis* | |
| 176 | Codinaea sp. (2.1)* | *M. carolinensis* | Wisconsin |
| 178 | *Dactylella tylella (1.6)* | *M. carolinensis* | |
| 181 | *O. penicillatum* | | NSW Australia |
| 182 | *O. penicillatum* | | NSW Australia |
| 183 | *O. penicillata* | | |
| 184 | *O. penicillata* | | |
| 185 | *O. penicillata* | | |
| 186 | *O. ulmi* | American elm | St. Paul, Minn. |
| 189 | *Diplodia pinea* (2.0)* | Jack pine | BRF |
| 190 | *Diplodia pinea* | Red pine | |
| 191 | *O. ips* | Austrian pine | Minnesota |
| 192 | *O. minus* | Austrian pine | Minnesota |
| 193 | *O. ips* | Austrian pine | Minnesota |

In the foregoing listing, O. indicates Ophiostoma, C. indicates Ceratocystis and L. indicates Leptographium. In the listing, the same species may be listed two or more times, indicating different locations at which the same species may have been identified, although varietal differences depending on location may be encountered. The listing also indicates that the same fungal species will infest in nature a wide variety of the species of same genera or tree type and even other tree types, eg. *L. procerum* is indicated to attack a wide variety of pines and also Fraser fir.

The generally preferred genus of such fungi include the Ceratocystis, Ceratocystiopsis, Chloridium, Codinaea, Dactylella, Diplodia, Graphium, Leptographium, Ophiostoma, Phialocephala, and Valsa. From the above listing, for example, cultures of particular interest for evaluation for use for particular substrates in particular locations where both the substrate and are found include the cultures having the list numbers 61, 62, 64, 65, 68–74, 76, 77, 79, 80, 83–85, 89, 91, 93, 94, 96–121, 124, 125–150, 153, 154, 157, 158, 162, 163, 165, 166, 171, 175, 181, 189 and 190. Most particularly of interest for use in the invention are the Ceratocystis, Ceratocystiopsis, Ophiostoma, Graphium, and Leptographium, especially and Ophiostoma, and more preferably Ophiostoma.

While a particular fungal species may degrade pitch as found in the wide variety of tree woods used after harvesting for pulpwood, particularly within the same tree classification, eg., a fungus infesting pines may degrade pitch in conifers, it will be generally preferred to use a fungal species which naturally infects at least one harvested wood of the same type or genus, eg., pines (Pinus), which is to be treated to reduce the pitch content. More preferably, the fungal species to be used in degrading the pitch in a particular wood species would be a fungal species which naturally infects the wood species actually being treated. In many instances it may be most preferred, by reason of local adoption or varietal changes, to employ the fungal species which naturally infects the harvested wood on a local or regional basis, it being noted that on a country-by-country basis government regulations may require that the fungus at least be naturally found in the country in which it is to be used.

As is evident from the foregoing listing, a wide variety of fungi suitable for use in invention have been identified and previously isolated. It is to be understood, however, that the foregoing list is only a partial listing of suitable fungi and that a host of other fungi of the character described exist and may be used. Suitable fungi may be obtained, for example, from governmental and other publically available or accessible culture collections. Where uncertainty may exist on a regional basis as to the more preferred fungal system, and since suitable fungi are indicated to exist in all locations on dead or harvested trees, logs and refined pulpwood, including even chip piles and sawdust collections at or around pulp and paper facilities, a local or regional collection, isolation, identification and evaluation on a routine basis in accord with the disclosure herein will be usually worthwhile in assuring the provision of the more preferred fungal system. While very suitable natural fungi are available, it will be understood that fungi which are mutagenized, ie. laboratory or scientist-induced mutations of the fungi required herein and which also exhibit the ability to deeply penetrate and remove pitch from the ray parenchyma cells may also be employed. The fungi to be employed in the present invention are those which do not substantially degrade the cellulosic content of the substrate and thereby materially adversely affect desired product qualities such as strength, an effect associated with the release of degradative cellulases by other fungi such as the brown rot fungi.

In determining the more suitable fungi for a particular application, factors beyond the ability of the fungus to penetrate deeply and reduce pitch content will also be considered on a practical basis. For example, since quantities of an independently provided inoculum will be required, the ability of the fungi to rapidly grow and provide large quantities of inoculum in desired form such as spores, may influence selection. Also, the invention in its more practical and preferred embodiments will be practised on non-sterile pulpwoods which will usually be infected by a host of microorganisms including bacteria and other fungi. The fungi to be used in such cases therefore desirably should be capable of growing on such non-sterile substrates in a reasonable time and those capable of the more aggressive growth on the particular substrate will be preferred. Fungal candidates, particularly isolated from the wild, are desirably inspected for undesirable viruses and other infections or adverse influence. Fresh, more vigorously growing isolates will generally be best. Selection of fungi which are naturally found on the particular substrate will be preferred candidates for healthy growth. While any indicated fungus which penetrates and removes pitch from ray parenchyma cells, may be employed, certain such fungi species such as *L. procerum, L. wageneri* and *O. ulmi* which are listed above have been indicated to be pathogenic to live trees and must be used with care and may be excluded from use by local regulation. Non-pathogenic fungi are desirably employed, as are particularly those which are non-toxic to animals, including humans.

The fungi within the above-indicated fungal classes which may be used in accord with the invention are, as above-indicated, not only the typical representatives of the classes, their genera and individual species, but also include all of individual strains, isolates, variants, mutants and the like which penetrate wood and degrade. It is generally within the skill of the art to provide or isolate strains or variants representing less common strains or variant of the same species, or to produce mutants, for purposes of obtaining those better suited for practical use. All such fungi are included within the scope of the invention. Hence, different strains or variants exist in nature and may be isolated in various ways, for example, by literally picking from cultures of the more representative species. For example, a faded strain of more typical dark-staining species may exist or arise spontaneously in an older, eg. 5–9 day old culture, of the dark staining fungus and appear as in eg. a light gray to medium gray spot(s) after plating of the culture, eg. as done for serial dilution. Such spots may be picked up and grown as individual isolates, to provide a variant strain.

Also, penetrating fungi, eg. blue stain fungi, are usually heterokaryotic. Our observations have indicated that many heterkaryotic fungi of the type in question may tend to be unstable when grown over several generations or even in a large scale, single batch. Parent stocks of fresh isolates, eg. stored in glycerol at 5° C. or frozen at minus 70° C., are preferably maintained and used to produce inoculum when desired on a regular basis. In the course of culturing, the nuclei segregate in cells in various combinations which change the characteristics of the strains, as is known, Variants formed in this manner may be isolated. Also, ascospores or homokaryotic cells or strains may be selected and cultured and may be recognized as of preferred for use in the invention as the characteristics of such strain or homokaryotic cells are stable. Selection may be as a result of varied procedures, as is known. For example, ascospores of a heterokaryotic strain are, by definition, homokaryotic. Spores may be recovered and individually separated, eg. plated on a solid growth medium at a dilution which allows growth. The resulting strains are tested for homokaryotic nature and evaluated as to retaining the overall desired properties of the parent fungi, or even an improvement thereon, eg. in pitch consumption properties (the ability to use ascospore selection to provide fungi combining the properties of reduced coloring effects and growth virulence on non-sterile substrates is hereinafter described). Alternatively, two strains may be crossed together (mated) by known procedure and the lineage is analyzed and evaluated, as indicated. A stable dark or blue-staining fungi may be obtained by such procedures.

Our invention was initially made with reference to certain true blue stain fungi and various darker isolates which embody very desired capabilities for use in the invention including ability to grow and penetrate wood substrates under non-sterile, essentially competitive growth conditions. A later blue stain isolate, herein TAB 28, which also exhibited good stability, became our standard. The one application drawback of a true blue or dark staining fungus is that its colors or stains the wood, typically a dark gray or blue black or black (these colors being sometimes tinted). Such dark staining fungi may result in the need to increase the degree of bleaching of the pulp at a later stage (in addition to creating an unsightly appearance), although such increase is minor and any added expense less than the savings from the pitch reduction. We nevertheless searched for lighter colored fungal variants among various preferred dark staining species and where able to literally pick from cultures of the dark fungi ligher spots representing variants which could grow up as lighter color fungi which resulted in less coloring effect on treated wood. While such "faded" isolates were also useful, as we expected, in accord with this invention, such faded fungal isolates and also other cultures of different penetrating, pitch-degrading fungi which are lighter staining or do not stain at all seemed to lack the overall virulence which made the dark staining fungi preferred candidates for practical use. Hence, the lighter or faded fungi which are naturally isolated or simply picked as spots from dark staining cultures were indicated more suitable for use on sterilized substrates as their lesser virulence indicates considerably higher dosages and/or longer treatment times on non-sterile substrate. While the faded isolates clearly indicate that the properties associated with production of a darker or blue stain (generally associated with melanin production in the fungus) are not essential for pitch reduction and use in the invention, it was uncertain whether such properties might be associated with the overall properties which made the dark or blue stain fungi the preferred fungi. As described hereinafter, it has been found that the process of ascospore selection can provide very suitable fungi which penetrate wood and degrade pitch and which have growth virulence on non-sterile substrates such that they can be very efficiently used on such substrates, and which provide other advantages associated with their reduced coloring effects.

The basic structural unit of most fungi is the fungal filament or "hypha". In aggregate, these filaments comprise a fungal body called a "mycelium". The fungi of the present invention typically reproduce asexually by means of spores called conidia or blastospores which are given off by the mycelia, or may reproduce sexually by means of ascospores.

An inoculation which may be in liquid or dry form may be provided by culturing the desired fungi in any of several conventional ways. The fungal culture may be prepared by any of the known techniques in the art for preparing such cultures. Solid or liquid culturing media may be employed as required or desired. The inoculum may comprise the fungal culture or spores and/or mycelia therefrom, or any other purified or essentially single culture form thereof which results in growth of the fungus on the substrate. The fungi to be used in the invention may produce good quantities of spores in solid or liquid culture, or both, depending upon the individual fungus. The generally preferred inocula will contain a large number of spores resulting from the fungal culture. The inocula are produced from purified isolates and essentially single species type cultures of the desired fungus, desirably in biologically pure cultures of the desired fungus, but need not be retained as biologically pure cultures prior to use so long as protected from contamination which would adversely affect the intended use or otherwise render the culture unsuitable. Where the nature of the fungi useful in the invention may permit, two or more such fungi may be grown in the same and otherwise biologically purified culture and the single species cultures referred to above will be multiple species culture but nevertheless derived from purified growths or isolates of each of the species.

In solid culturings for example, the fungus may be grown on a solid basal malt medium comprising malt extract and yeast extract on agar plates. To prepare the fungal culture for inoculation, spores are scraped from the agar surface and suspended in water. Spores which form within the agar are obtained by homogenizing the agar in water and filtering the resulting mixture through sterile cheese cloth.

Liquid malt extracts which may be conventionally prepared may also be used. Such preparations are generally subjected to agitation during fungal growth in order to promote initial growth and subsequent spore formation for those fungi forming spores in liquid media. Fungi producing large amounts of spores in liquid culture are usually preferred as a matter of preparation convenience.

The culturing medium may affect the morphology of the fungal culture, as is well known.

Certain fungi, such as Ophiostoma sp., exist in yeast-like form under liquid culturing conditions, and quickly produce an abundance of spores. Such fungi are preferred from the standpoint of ease of handling in the process of the present invention, because such spores may be concentrated and frozen and then diluted with water before application to the wood substrate. Such fungi produce blastospores, a preferred inoculum. The spores readily adhere to the refined pulpwood substrate when such liquid form are used for inoculation.

A preferred inoculum will generally comprise a fungal culture or fungal preparation which comprises at least 50% spores, more preferably at least 80%, and most preferably at least 90% spores, such spores being yeast-like cells when produced by the fungal type.

The inoculum may be in liquid or dry form, eg. lyophilized. Inoculum in dry or liquid form may be used as such or diluted, eg. with water or other diluent not adversely affecting the inoculum or its growth, prior to use. The wood substrate may be separately moistened prior to applying a dry inoculum. It is particularly preferred to keep the inoculum frozen, at at least minus 10° C., preferably at at least minus 15° C., suitably at about minus 20° C.

The inoculum may also comprise additives such as preservatives and stabilizing agents. Examples of such agents include silicon dioxide, skim milk, polyethylene glycol, polypropylene glycol and sugars such as fructose, glucose and sucrose.

The refined pulpwood which is to be used as the substrate for inoculation according to the process of the present invention preferably comprises wood chips prepared by conventional industry wood chip manufacturing methods. Other divided or broken up wood forms conventionally sent to first stage pulping treatment, such as sawdust, may also be treated in the invention process. The wood may derive from a single tree species or from a mixture of different species. When different wood types or species are involved, an inoculum of different fungi, eg. one for each wood species, may be applied as a single, mixed inoculum or as a number of separate inoculums.

The inoculum may be applied to the refined pulpwood substrates in a variety of ways and the process of the invention carried out in any of several embodiments. In one preferred embodiment, the inoculum is sprayed or dusted onto the pulpwood substrates as they are discharged from the refining operation and just prior to being accumulated for holding prior to entry into the pulping process. For example, mechanical wood chipping equipment is typically designed and placed such as the newly prepared chips will be discharged to the accumulating wood chip pile, either directly from the discharge end of the equipment or from a conveying means, such as a mechanical or pneumatic conveyor, which receives the newly prepared chips and deposits the chips in the accumulating wood pile. A suitable applicator for the inoculum, such as a duster or spray applicator, is suitably located either at the discharge end of the chipper, along or within the conveyor means or at the discharge end of the conveyor for purposes of applying the inoculum to the chip. The inoculum may be applied to the chips while on or in a conveyor system, for example, by installing the in-line sprayer hereinafter described in the conveyor system just short of its discharge end. It is also suitable to apply the inoculum when the chips are airborne, eg. free falling or when tumbling, and particularly when being discharged from the chipper to the conveyor means or reservoir for the conveyor. Application at the discharge end of the conveyor may provide the advantage, with the dust or spray properly directed, that a good portion of the inoculum will contact the chips and any portion which does not contact the chips will fall onto the accumulating chip pile and enhance the desired inoculation. Other methods of inoculation will occur to those skilled in the art. For example, the inoculum may be applied directly to the wood chip pile in the process of its accumulation by more or less continuous spraying or dusting over the accumulating wood pile such that the inoculum will be applied essentially to each accumulating layer of roughly 6–12 inches, but such a process is less preferred. Refined pulpwood, eg. chips, which had been previously inoculated and maintained in accord with the invention may also be dispersed into the fresh chips to effect or enhance inoculation. Such an inoculum will not be at all biologically pure when the prior treated refined pulpwood was unsterilized but will have been derived from the purified culture used to inoculate such chips or prior chips. Desirably, such chips will reflect the prior inoculation by the purified culture by indicating on analysis that at least about 40%, preferably at least about 50%, of the total fungal growth thereon will be a fungus or fungi of the type specified for use in the invention. It is not necessary that each individual wood chip, sawdust particle or the like be inoculated by the particular inoculation process which is employed. As little as about 10% or even less of the individual pieces or particles need be inoculated since the individual pieces are accumulated in contact with a number of other pieces and the growing fungus will spread and infect nearly pieces including those which have not been inoculated. Preferably, at least 20% of the individual pieces will be inoculated, more suitably at least 2.5%, eg. 25–60%. It is desirable, however, that the inoculation be applied more or less steadily or uniformity such that the final accumulation, typically a conical or truncated mass with height of at least 20 feet in the case of wood chips, will be inoculated thoroughly or substantially throughout, preferably such that 25–60% or more of the individual pieces in the accumulated mass will be inoculated at the beginning of the treatment. The pulpwood may also be immersed in a bath or wash of inoculum to obtain inoculation of essentially all of the individual pieces in the case of refined pulpwoods, eg. prior to accumulating in the typical wood chip pile.

After inoculation the accumulated mass is maintained under conditions which will allow or promote the growth of the fungus substantially throughout the mass. Given the fact that the invention will in most cases be likely to be practiced out-of-doors and the mass subjected to a wide variety of weather conditions, in addition to influences on the accumulation by the action of the fungus and other organisms within the mass, the maintenance of any given set of ideal conditions, particularly throughout the entire treatment period, will be usually too difficult to achieve and is unnecessary as a practical matter. It is generally adequate if substantially the entire mass is maintained at at least a temperature at which the fungus will grow while avoiding the higher temperatures at which the fungus will die. The use of a penetrating pitch-degrading fungus well suited to the local temperature conditions will therefore be a factor in selection of the fungus to be used. While many fungi may exhibit some measure of reasonable growth at or below 32° F., it will be generally more suitable to attain a temperature of at least 33° F. substantially throughout the accumulation, and the maintenance of temperatures in the range of 33° F. to 110° F., will generally be sought. Preferably, the maintenance of temperatures of 50° F. to 100° F., and more preferably 60° F. to 90° F., substantially throughout the accumulation and substantially throughout the treatment period, will provide the more effective results with most fungi which are useful in the invention. The use of different fungi at different times of the year to provide those more suitable for growth under the various seasonal temperature condition is of course within the scope of the invention. In warm climates or in warmer weather conditions, the process may be carried with the inoculated pulpwood accumulation as formed and without the need to otherwise influence temperature conditions in order to maintain suitable temperatures within the accumulation. In cooler climates or in colder weather conditions, particularly when freezing temperature might be encountered, various means may be employed to maintain suitable temperatures. A primary choice of means for maintaining growth temperatures is a heat-retaining covering over or on the accumulation, and such a covering may be very conveniently provided by one or more or large plastic sheets or tarpaulins (waterproofed canvas) which will cover all or almost all of the accumulations. The use of a covering by itself may be adequate in many colder weather conditions to allow the maintenance of temperatures suitable for fungal growth, after a relatively short lag time to allow for natural temperature build-up within most of the pile to the required minimum temperature under the colder conditions. Under the colder conditions or as desired, means may also be provided in a variety of ways to heat or add heat to the accumulation. For example, the accumulation may be made on a fine grate-like structure covering heating pipes which may simply provide radiant heat or which may contain a plurality of openings or jets to release a heated gas, eg. air. In a similar manner, a concrete "igloo" or similar structure which can be internally heated and emit radiant heat may be used to support the accumulation. Heated or heated-gas emitting pipes may actually be inserted into the accumulation at various locations to provide desired heating, and it will be apparent that other means for providing desired heat to the accumulation will occur to those skilled in the art. Steam may be used along with other heating means to also provide moisture and avoid excessive local drying created by other heating means, but steam will be used judiciously to avoid excessive moisture build-up. Heat may be applied steadily or intermittently as required to regulate the mass temperature within the desired temperature range. When the accumulation is covered, the covering may be fitted with means to allow for venting of heat and moisture to avoid an undesired heat and/or moisture build-up when temperatures become unreasonably warm during treatment or near the end of the treatment as a result natural heat build-up. A tarpaulin or plastic sheeting with a plurality of openings each covered by flaps attached to means such as rope to operate the flaps and expose the openings may be provided for such purposes. A plurality of temperature sensing devises may also be placed within to accumulation to monitor temperatures at various locations and detect any undesired or excessive hot-spotting within the accumulation. The invention could encourage the construction of large buildings to house the usual out-of-doors wood chip accumulations and thereby substantially reduce the influence of seasonal temperature fluctuations, particularly cold temperatures, on practice of the invention.

The accumulation may also be made in a container-type structure including transport means such as a rail car, ship or the like to allow pitch reduction to be effected during transport.

The time of treatment from the presence or establishment of a fungl growth temperature may vary considerably depending upon a number of factors including the extent of pitch removal desired, the internal temperature and condition (including pre-existing microbial infection) of the pulpwood, the surrounding temperature conditions, the extent of inoculation and the particular fungus employed. However, in general, satisfactory results may be obtained during treatment times extending from 4 to 45 days. More usually, the treatment time will be from 7 to 35 days. Under preferred conditions, very effective results may be obtained during treatment times of from 5 to 20 days after inoculation. In general, a pitch reduction of 20% or more compared to the starting pulpwood material is significant and a welcomed benefit which may be readily achieved by the invention and which will extend the time between shutdowns for pitch problems in mechanical pulping. Reduction of 30% and more may be achieved in the practice of preferred embodiments and greater reductions may be obtained by extending the treatment times. It is indicated that not all pitch in the wood need be removed to obtain essentially optimal benefits and the proportioned benefits appear to exceed the percentage removed when high amounts are not removed. When the pulpwood is a mixture of different woods, including different species, it may be preferred to use two or more fungi selected such as to have at least one which is optimal for each wood type. Since different fungi which naturally degrade pitch in the same wood species may do so by different mechanisms or act to different degree on different pitch components, it is within the scope of the invention generally to employ two or more such fungi in a single treatment and to obtain the enhanced benefits of such combinations. Hence, two or more inocula from biologically pure cultures may be separately applied or two or more such inocula may be combined and applied together. Since non-sterile pulpwood treated by the invention process may contain other microorganisms including on a random basis those of the type useful in practicing the invention or which may otherwise act on pitch, it will be evident that some benefit in achieving desired results can be expected from such microorganisms. The process may be applied therefore, if desired, to aged chips or chips prepared from aged timber (timber held or set aside for more than two months prior to chipping or the like), but the process is desirably applied to freshly prepared chips and is advantageously and suitably used with chips, sawdust and the like prepared essentially only from freshly cut timber (ie. unaged or timber which is chipped not more than one month after cutting), thereby avoiding the added inconvenience and cost of the lengthy storing of logs for whatever advantages in lessening pitch may have been possible in some cases.

On the other hand, the invention may be applied, as indicated, to cut (unrefined) timber, particularly where lengthy outside storage may be considered an efficient or necessary practice. The scoring desired to facilitate inoculation may take place naturally in the course of harvesting and collecting the timber or may be intentionally applied. In any case, the inoculation will be effective to cause growth of the fungus well into at least the sapwood, and inoculation of the cut ends is also desirable and may alone suffice with cut logs. Treatment times will usually be somewhat longer than with unrefined pulpwood and may extend for two months or even longer in the colder weather conditions. Refined pulpwood from said treated timber may then be sent directly to pulping, or additionally treated after refinement.

The process of the invention may be generally applied to all refined pulpwood used in the manufacture of pulp within the pulp and paper industry and other industries which use pulpwoods, including pulp for paper such as newsprint and fine white papers and paperboard products such as cardboard. The process therefore may be applied to pulpwood used in both of the two general categories of pulping processes, ie. mechanical pulping and chemical pulping. Mechanical or high yield pulping processes include the subcategories of groundwood pulp, thermomechanical pulp (TMP) chemimechanical pulp (CMP) and chemithermomechanical pulp (CTMP). The invention will be particularly applicable to pulpwood for use in mechanical pulping processes since these processes, which produce for example newsprint, remove less lignin and leave larger amounts of undegraded and releaseable pitch to hamper papermaking machinery than the chemical pulping processes (eg. the kraft process). The invention will be especially beneficial in thermomechanical pulping processes (TMP). In the mechanical pulping processes, at least two actual pulping stages are typically employed (in addition to one or more later brightening or bleaching stages). The product of the primary or first mechanical pulping state generally still contains a high proportion of lignin, at least 60% of the original lignin, and a relatively high proportion of the pitch content of the wood chip or other refined pulpwood entered into the process.

In general, pulps which are passed through a papermaking process retain a high proportion of their pre-pulping pitch content which usually becomes a problem at or near the paper-or product-forming stages of the overall process for making product from pulp. As previously indicated, the present invention also contemplates treating pulps to reduce the pitch content thereof. For such purpose, the treatment process is similar to that used with chips, eg. the pulp is inoculated and accumulated, eg. in large piles or mounds, or accumulated in thick mats or rolls of thick mats with mat thickness of at least about 3", and maintained under the conditions previously indicated for a time sufficient to reduce the pitch content thereof. The resulting pulp may then be processed in the remaining stages of the pulping processes. Pulps may be most advantageously treated when pulpwood forms were not previously treated to remove pitch. Pulps in both mechanical and chemical pulping processes may be treated. Desirably, pulps will be treated prior to the stage in which pulp is chemically treated to bleach the pulp as in chemical pulping processes or to treated to brighten the pulp or prevent brightness reversion in the case of mechanical pulps. Mechanical pulps which still contain a high proportion of lignin, eg. at least 60% of the original origin, which pulps also contain a high proportion of the pitch content of the refined pulpwood entered into the pulping process, are very suitable pulp candidates to treat to reduce pitch. In certain mechanical pulping processes, at least two actual pulping stages are employed prior to chemical treatment for brightness properties. The product of the primary or first mechanical pulping stage is particularly suitable for treatment to reduce pitch. Also particularly suitable are pulp forms which individual processors may store for seven or more days prior to continuing or reentering into the overall process.

The temperatures and/or treatment conditions, including subsequent chemical treatments, eg. bleaching or brightening treatment, employed in most all conventional pulping processes are more than sufficient to kill and otherwise destroy the viable fungi employed in the invention, and the resulting residues of the viable portions of the fungi are indicated to be absorbed by the pulp and/or eliminated in the processes without adverse affects. In any case, heating of the mass to temperatures of 250°–300° F. for a brief period of typically 15–30 minutes will usually kill the fungus.

The pulpwood or pulp resulting from treatment with a penetrating fungi in the process of the invention may in general be processed in essentially a conventional manner in the remaining steps in the overall pulping process into which it is entered or produced. If color is added by the treatment, only minor adjustments may be required to negate any impact on the color of the ultimate product. In general, the conventional pulping processes involve chemical treatments, including brightening and bleachings, and other conditions which as conventionally practiced are capable of substantially reducing if not entirely eliminating any added color or stain by the time the processed pulp is ready for the final paper or paperboard-making steps. Any residual traces of coloring which may remain may be sufficient to only require attention in connection with chemical pulping process which are generally used to produce quality white papers, and hence may be entirely acceptable in connection with the products of mechanical pulping process. In either case, such any residual color effects may, if desired, be removed by increasing the intensity and/or length of treatment in the brightening or bleaching stages conventionally employed, with minimum at added expense and very good results may be obtained without staining to an extent that would require the addition of new treatment stages. The physical properties and other quality factors of paper and paperboard products resulting from practice of the invention are not only not indicated to be adversely affect product quality but positive results, particularly as regards strength properties, are indicated to be provided, and are particularly indicated in connection with mechanical pulping process products where heretofore the greater amounts of residual pitch have been carried through to the paper-making end of the process and into the product itself.

The lengthy disclosure immediately following concerns the provision of ascospore-derived fungi combining desired properties, particularly virulence and reduced coloring effects on non-sterile substrates, for use in its invention. A disclosure concerning such ascospore subject matter is also given in U.S. patent application Ser. No. 07/560,521, filed Jul. 31, 1990, now abandoned and entitled Fungi For Pitch Reduction and Their Preparation, the disclosure of which is incorporated herein by reference.

Basically, the generally known technique of ascospore generation, isolation and selection of fungi can be used to provide, for use in the invention, fungi combining good growth virulence on non-sterile substrate and reduced negative coloring effects compared to the darker coloring or staining fungi, or even minimum or no coloring effects, and potentially even enhanced brightness compared to untreated substrates. An improvement in the isolation of such ascospores of pitch-degrading fungi was also used in the process of providing such desirable ascospore fungi.

A method of providing wood-penetrating fungi for reducing the pitch content of wood substrates comprises: a) isolating ascospores of a culture of one or more wood-penetrating, pitch-degrading parent fungi of the class of Ascomycotina or Deuteromycatina; and b) selecting any one or more homokaryotic fungi provided by the ascospores that are characterized by the criteria of i) growing on a sterilized wood substrate to reduce the pitch content of the substrate by at least 20% after no more than 21 days growth, preferably no more than 14 days growth, and which are further characterized by either or both of the criteria of ii) affecting brightness of the same, sterilized substrate after 21 days growth negatively to no greater extent than a referenced parent fungus (if there is more than one parent, only one need be referenced for comparison) while growing more virulently than the referenced parent on the same but non-sterile wood substrate as determined over a growth period of 10 days, or iii) producing a higher brightness level or value on the sterilized substrate than the parent fungus after 21 days growth while growing substantially no less virulently than the parent on the non-sterilized substrate as determined over a growth period of 10 days. An inoculum for use in the invention may be obtained from such a homokaryotic fungal isolate, or the progeny or a derivative of such fungi.

The process of ascospore selection is used to provide species by species improved fungi for pitch-degradation use, either by providing greater virulence on non-sterilized substrates while at least retaining brightness level effects of the parent fungus, but particularly by providing, relative to a parent fungi, those which produce enhanced brightness levels, as can be determined on a sterilize substrate, while growing substantially no less virulently on the same but non-sterile substrate. Such homokaryotic fungi can be highly effective and desirable for use in pitch-reduction, particularly on non-sterile substrates, and can act effectively in practical use after no more than 14 days growth at inoculation levels not exceeding $10^{10}$ CFU (colony forming units) per Kg. of substrate, such as refined pulpwoods, and can even be effective after no more than 10 days growth at such inoculation level. Fungi provided by the invention process are indicated to be generally novel on a species by species basis, ie. new within each species type, as are certain particularly preferred ascospore derived fungi which can be defined differently and in relation to their more absolute effects on brightness on non-sterile pulpwood.

Non-sterile substrates are typically infected with a wide variety of microorganisms and in many cases infected with fungi of widely varying types which can stain or color the wood, including in some cases blue stain fungi which may grow in time, and often rather quickly. All such coloring or staining fungi (or other organisms) will color the wood (in any of a variety of colors such as black, blue of different shades, reds, greens and orange) and bleaching treatments are usually adjusted by adding bleaching agents to overcome such effects when encountered to a significant degree, at least with mechanical pulps. The use of a penetrating fungus to degrade pitch may increase bleaching requirements when the fungus itself imparts or leaves a darker color residue or on the wood. By ascospore selection it is not only possible to obtain fungi which grow rapidly at efficient inoculation levels on non-sterile wood, while reducing negative brightness effects relative to the parent, pitch-degrading parent fungi, but it is indicated, in accord with a particularly preferred objective and embodiment, that the brightness of the wood substrate can not only be minimally effected or substantially unaffected relative to untreated, non-sterile controls (representing a typical commercial wood chip pile) but can even be enhanced compared with such a control. Such particularly preferred fungi and their use on non-sterile substrates, including substrates which are moderately or even greater naturally infected with coloring or staining fungi, are viewed of great interest and practicality since pitch can not only be reduced with its attendant cost savings and improved paper/product strength properties, but the brightness of the treated substrate may be unaffected or even enhanced relative to untreated pulpwood as normally entered into a pulping process. While such brightness benefit may be due to a minor extent to a light or substantially white residue remaining from the mycelia of such particularly preferred fungi, such benefit is indicated to be largely provided by the ability of such preferred fungi to grow into or exclude other coloring fungi or organisms in locations where such other organisms would otherwise grow over the treatment period, eg. 14 days. Non-sterile pulpwood treated with such particularly preferred fungi are also considered novel since it is indicated, as we have experienced, that such substrates treated with other very light growing or faded fungi having the reduced virulence or competitive growth (relative to their own reduced coloring effect), even when inoculated at relatively high dosages, will act largely on locations where the native coloring fungi or other organisms will not spread and are insufficiently competitive to exclude enough of the growth of the nature coloring fungi to positively impact on brightness. Such novel pulpwoods and the fungi which produced them may be defined relative to natural infection with coloring fungi or organisms when a non-sterile control (untreated) sample exhibits sufficient infection that its brightness is reduced by at least ten percent (10%) at room temperature relative to sterile, untreated samples over the treatment period, eg. 14 days, whereas the novel fungal treated substrates have a brightness level at least equal to or greater than the brightness level of said non-sterile and untreated pulpwood control after the treatment period, eg. 14 days. Those fungal treated substrates having improved brightness compared to the non-sterile, untreated control sample will be especially desired products for further processing, especially in the manufacture of mechanical pulp products.

Ascospore selection is particularly applied, but not limited to, selection from cultures of fungal species which have at least one dark or blue stain member or representative, including faded, gray color members or variants of such species, whether such ascospores arise from self-fertile species members or by the mating of species members. The term "parent fungus" as used herein means any fungus which produced the ascospores in culture. If two fungi are mated, for example, it means either of the two mating. If multiple mating types are involved and more than two mating types can combine, then it means any of the mated fungi. Most fungi involve only two mating types. Hence, if two or more parents are involved in producing the ascospore, any parent may be referenced for purpose of determining whether the screening criteria are met, providing the same parent is always referenced for all minimally necessary criteria in each evaluation of the ascospore in question. Both or all parents will usually be individually referenced in a series of evaluations of each parent separately for each ascospore. Criteria will be judged to be met if the criteria are met relative to any parent, as indicated. Especially preferred ascospores will of course be indicated when criteria are met for all parents, eg. two parents of considerably different color and in general very desirable candidates are produced when the ascospore approaches, or equals or exceeds the best of the two desired properties as embodied in any parent, eg. the virulence of one parent and coloring effects of a second patent. In any selection of ascospores from an ascospore-producing parent or mating, a preliminary screening can usually be employed to rule out most of many individual candidates produced, and a criteria screening done on the few indicated as reflecting desired properties.

The fungi in question, including the blue (dark) stain fungal species (including their faded members) are generally presumed heterokaryotic, that is, they contain multiple nuclei each containing the full complement of genes necessary to support life of the fungus. By allowing such fungi to sporulate under certain conditions, such as a solid culture, eg. on an agar plate, followed by isolating spores containing single nuclei (ascospores), and growing the ascospores as separate colonies (thus generating homokaryotic strains), candidates for screening are obtained. The isolated strains are then screened for desired properties. When a parent fungus is not self-fertile, it must be mated with an appropriate or compatible mating partner of the same species to provide ascospores, as is known in the art. All possible variations in procedures for obtaining ascospores may be used. Such basic procedures for such ascospore generation and isolation are well known although an improved ascospore isolation procedure is disclosed herein in connection with such fungi. Fungi entered into the procedure as parents may be pre-screened for desired properties.

Homokaryotic isolates, as in the case of fungi growing as homokaryotics, as well as heterokaryotes, may be mated by known technique to produce ascospore cultures. Any resulting homokaryotic fungi may be mated with another member of the species, including its parent fungus, to provide ascospores for selection, provided appropriate mating types are indicated. The mating of such ascospore isolates may be with another ascospore isolate or with a wild type. Hence, it is well within the scope of the invention to use the initially obtained and selected ascospore(s) to obtain other ascospores of desired improved properties, and to continue such generation of new ascospores by such mating as desired.

The procedure may be applied to fungi of all colors, from white to black, whether or not individual strains or variants are self-fertile, as can be determined by known techniques. It is generally preferred to initially use the mating procedure when a true dark or blue stain (unfaded) strain is to be explored, desirably with one partner being the true blue stain and the other a lighter member. Prior to mating, the basic procedure may be used if desired with self-fertile strains to obtain ascospore-selected isolates for the mating. Thereafter, the resulting isolates may be also subjected to matings, subject to having appropriate mating types. For example, it is indicated that the light isolate C1 det 5 (C-1D5), hereinafter, is suitable for mating with the true blue stain fungus TAB 28.

When a light or white growing ascospore isolate is to be further mated, it is preferred to mate it with a strain which is darker and more virulent than the lighter ascospore strain.

Hence, the invention includes not only individual ascospore isolates and their resulting fungi but also all of the additional derivatives obtainable therefrom, particularly those embodying at least the level of desired properties of the parent ascospore. A finally selected ascospore fungus may be mated to provide a heteroyaryotic fungus for use in pitch degradation, but this may not be preferred when the resulting heterokaryon is found to tend to be unstable in one or more basic properties during repeated growth or large scale growth. The Ascospore may also be mutagenized to provide other desirable derivatives, including scientist-induced mutations, and those which at least substantially embody the desired improved properties of the parent ascospore are also included in the invention.

Procedures for the generation, general separation, dispersal and individual isolation of ascospores and the growth and isolation of fungi they generate are well known. A representative literature reference is, for example, Upadhyay, H. P. (1981), A Monograph of Ceratocystis and Ceratocystiopsis; University of Georgia Press, Athens, pages 28–29. A publication with specific reference to ascospores of Ophiostoma is Brasier, C. M. and J. N. Gibbs (1976), Inheritance of Pathogenicity and Cultural Characters in *Ceratocystis ulmi*: Hybridization of Aggressive and Non-Aggressive Strains; Ann. Appl. Biol. 83, 31–37. In general, the parent fungus (or fungi) will be cultured to the stage where ascospore generation is sufficiently complete and the ascospores sufficiently liberated from the fungal mass or secreted that the ascospores as a mass or collection can be generally separated or recovered, for example, by picking all or one or more portions of the viscous, hydrophobic ascospore-containing material at the top of the perithecium with a sterile dissection needle and transferring to a specialized spore suspension medium such as the usually recommended pinene which will dissolve the hydrophobic material and free the spores into the suspension medium. The medium (or portions thereof) containing the ascospores is then diluted and the dilution spread on plates containing a suitable growth medium for development of a solid phase fungal growth in a manner which allows the ascospores to develop or grow into discrete or individual fungus colonies which can be picked or isolated for further growth in individual cultures, eg. liquid culture, to provide inoculum for evaluation of the fungus produced or generated from the individual ascospores.

It will be noted, however, that the standard pinene procedure was found to produce very few viable spores, whereas many were needed for screening. It was then found that very high and suitable counts of viable ascospores of the subject pitch-degrading fungi may be obtained by taking up or dispersing the ascospores in their hydrophobic carrier as recovered from the fungal culture in a non-toxic oil which effectively dissolves the hydrophobic material to free the spores into the oil and which is consumable (as a food or carbon source) by the fungus, preferably a vegetable oil such as corn oil, and then treating the ascospore-containing oil with a non-toxic (to the fungus or its spores) oil dispersing agent which may be of any of the many known types for dispersing such oils, such as the well known Triton® X100. The spreading or plating out of the dispersing agent-treated oil results in large number of discrete, viable ascospore-containing droplets of said oil and, additionally, the oil is consumed and removed from plates as the fungus grows, leaving discrete fungal colonies which can be readily recovered and further cultured for evaluation.

Other Preferred Embodiments and General Evaluation Standards for Ascospores

A determination of whether or not the ascospore selection criteria are satisfied will be conducted on a laboratory scale. While reference may be made to the Ascospore Experimental Section herein for guidance in certain cases, the determination will be made in accord with the description and discussion under the above paragraph heading and the next two paragraph headings (Other Laboratory Evaluation Standards For Ascospores and Evaluation Procedures For Ascospores), and it is not represented that the experiments in such Experimental section conform in particular aspects to such determination description.

With regard to criteria i), above, ie. pitch reduction, such evaluations are carried out on sterile substrates to eliminate the influence of other organisms which naturally infect non-sterile substrates. Generally, a pitch reduction of at least 20% in 21 days will be desired for the more suitable candidates. Reductions of at least 25%, particularly at least 30%, will generally indicate the preferred candidates. If criteria are met at 21 days, repeating the evaluations and achieving the level of at least 20%, 25% or 30% pitch reduction in 14 days will usually indicate the more preferred candidates.

One preferred group of ascospores for selection or initial selection, particularly when a parent is of a medium to dark gray, and the criteria are met, will be those producing an ascospore fungus which will reduce the pitch content of the sterilized substrate by at least 25% in not more than 21 days without decreasing the brightness level of the sterilized substrate by more than ten percent compared to an untreated, sterilized control.

With regard to criteria ii) and iii) and the evaluation concerning brightness, these evaluations are desirable conducted for screening purposes on sterile substrates to again eliminate the influence of organisms which naturally infect non-sterile substrates and obtain a more absolute assessment of the color influence of the candidate. These evaluations will also be conducted after growth for 21 days. When an improvement in brightness level is the criteria, an improvement of at least about 5% is usually sought to reduce error and provide statistical confidence. The degree of improvement otherwise obtained may vary considerably. If a medium to dark color fungus is involved as a parent, improvements of the order of at least 10%, 15%, 20%, 25% or even more may be realized. If lighter parents are involved, lower orders of improvement may be realized, as would be the case when seeking to improve a previous ascospore isolate selected for brightness. Of course, no brightness involvement may be realized at all and criteria met when selection is to be made on the basis of growth virulence.

Growth virulence determinations in accord with criteria ii) and iii) will be conducted on a non-sterile substrate and made 10 days after inoculation to reflect the desired fungi provided by the invention. Such determinations are made as herein further described, on the basis of percentage of substrates or wood chips showing growth of the candidate compared to growth of the referenced parent. Such determinations may be made on a percentage basis and, when an improvement in virulence is the criteria to be satisfied, an improvement of at least about ten percentage points (ie. 80% to 90%) is usually sought to reduce error and provide statistical confidence. If the determination is to be made on the basis of virulence and both the referenced parent and candidate fungus show 80% or better growth, the evaluation/criteria dosage of $10^{10}$ CFU per kilogram of substrate is reduced until the referenced parent growth is less than 70%, eg. 35–65%.

A determination of the satisfaction of criteria ii) and iii) may be dispensed in certain cases where certain ascospore fungi or their derivatives, desirably also a homokaryotic derivative, meet certain particularly preferred characteristics reflecting brightness and virulence on non-sterile substrate. In particular, desirable new fungi are provided by this invention when pitch reduction criteria are met on sterilized (and non-sterilized substrates) after 21 days as described above, and a control non-sterile substrate after 14 days is sufficiently influenced by native organisms that its brightness is reduced by at least 10%, especially by at least 20%, compared to a sterilized, untreated control, yet the ascospore derived fungus results in a brightness level, at the end of said 14 day period on the non-sterile substrate, which is at least as great as the brightness level of the untreated, non-sterile control. Such fungi are indicated to be novel relative to prior art fungi. A particularly desirable class of such fungi are those which actually increase the brightness, eg. by at least about 5% or more, compared to the untreated, non-sterile control. Preferred sub-classes of such fungi are those which effect either such desired result on at least one wood species or variety at dosages less than $10^{10}$ CFU/Kg., particularly at dosages not exceeding $10^9$, and especially dosages not exceeding $10^8$, and most preferably at dosages not exceeding $10^7$.

Other Laboratory Evaluation Standards for Ascospores

In carrying out the invention to isolate desired ascospore fungi meeting criteria in accord with the invention, various comparative evaluations will be made on pulpwood substrates to determine pitch reduction, brightness and virulence. These will be conducted on a laboratory scale. While the substrate may be of different pulpwood forms, the criteria standard and more suitable form is wood chips. The substrates will be obtained from fresh cut timber or logs stored at room temperature for seven (7) days immediately after cutting, and then made into wood chips which are promptly subjected to evaluation (or stored for a brief period at minus 20° C.). Wood chips showing after such seven days anything other than isolated or very minor visible growth of native fungi such as blue stains, Papulaspora and Trichoderma are rejected. Such substrates are selected to be free of knots. Each evaluation will be done on substrates of the same wood species and on substrate samples obtained from the same timber or log, and at the same time after cutting of the tree. A collection of such substrates exceeding evaluation requirements by at least 3 times will be thoroughly mixed to disperse isolated pieces which may be naturally infected or more heavily infected with microorganisms. Individual sample lots of equal size (weight) and amounting to 200–400 grams each will be taken from the collection. Samples to be sterilized are heated in an autoclave at 120° C. for 45 minutes. Evaluations on non-sterile substrates may be started 7 days after cutting of the tree. Evaluations for comparison on sterile substrates are commenced at roughly the same time or slightly later, preferably after wood chips from the cuttings have been sterilized and allowed to completely cool to room temperature (ca 20° C.), at which temperature all evaluations will be made unless the referenced parent fungus optimally grows below 10° C., in which case the evaluations will be conducted in an environment stabilized at the optimum growing temperature. The inoculum will be applied as a concentrate or deionized water dilution from a culture at a inoculum concentration which together with the manner of using it to inoculate will not introduce more than about 1 ml. of water for each 100 g. of substrate. The dosage itself will be expressed in colony forming units representing the count by standard procedures of the total of viable mycelia and/or viable spores in the inoculum. The dosage applied will be same and not exceed the criteria maximum of $10^{10}$ CFU/kg. of substrate (prior to sterilization in the case of the sterilized sample). The inoculum will be in a form as similar as possible for the referenced parent fungus and ascospore fungus being evaluated. Hence, if the inoculum for one is essentially only mycelia, the inoculum for the other will be essentially only mycelia and harvested at an equivalent growth stage. In a like manner, mixtures of spores and mycelia will be in the same proportions. If the fungus can provide a high proportion of spores (75% or more of CFU) in culture, as is usually the case, an inoculum which is 75% or more spores of similar characterization will be used. Hence, if the fungus forms a high proportion of blastospores, such an inoculum will be used. The inoculation of the substrate will be done in a manner suited to contacting as many individual wood pieces as reasonably possible, even though initially only 10–30% of the chips may be actually contacted. The wood chip substrates will be placed in clear plastic bags of good size and the chips in the bag rested and spread out on a flat surface. The inoculum will be applied with an eyedropper by placing no more than one drop on individual chips. The bag is then sealed and the chips mixed/shaken thoroughly for 10 seconds to distribute the inoculum to other chips. The bag is then tightened or further closed around the chips if necessary to have good contact among chips in a pile-like accumulation. All inoculated substrates will be stored in the dark and then evaluated, the storage being done at room temperature except in the cases as indicated above. Each evaluation as above described will be run in triplicate and the results averaged, and each triplicate series will again be repeated three more times (total of four triplicate series) but using in each series samples from a different tree of the same species and variety within the same forest location. For obtaining the best fungi on a local or regional basis, it is preferred to isolate or derive the parent fungi from cut or dead timber or other pulpwood forms of the same species of wood respecting which the ascospore-derived fungus will be used in practical application, or otherwise conduct the evaluation on substrates of the use-targeted wood species type on which the parent was obtained or derived. If the wood species source of the parent fungus is unknown, a preliminary evaluation on sterile and non-sterile wood chips from several different wood species and varieties which the parent fungal species is known from the literature to infect will be conducted, and the evaluation will be conducted on the wood species or variety respecting which the parent fungus reveals the more vigorous growth. Ascospores-derived fungi meeting the criteria as above-stated relative to any referenced parent on any of the many currently known sources of pulpwoods, or on a targeted substrate wood species, will be new and useful in accord with the invention. The criteria can be expected to be best met by the ascospore fungus when the substrate is the same wood species and variety from which the parent fungus may have been isolated on a regional basis.

Evaluation Procedures For Ascospores

A) The pitch content of substrates is determined in accord with the standard TAPPI Procedure T204 OS-76 and may be expressed as mg. of pitch content per gram of substrate which had been extracted with DCM (a.k.a methylene chloride). As used on a substrate such as wood chips, the treated chips are splintered with pruning shears to a width of about 1 cm, then dried overnight at 60° C. and then ground into sawdust using a Thomas-Wiley Intermediate Mill with a 10-mesh screen (10 gauge wire screen), and dried again overnight at 60° C. Three (3) grams of dried sawdust are combined with about 30 ml. of DCM and the resulting mixture agitated overnight (about 15 hours) at room temperature. The liquid medium is pipetted from the mixture, filtered through a 0.45 micron organic filter, the liquid allowed to evaporate at room temperature overnight (for about 15 hours) in a preweighed dish and the residue oven-heated at 60° C. for 30 minutes to further remove DCM. The weight of the residue is determined in mg. as the pitch content and expressed either as mg. of pitch content per gram of substrate or as a percentage of pitch in the original substrate (% extractives).

B) Substrate brightness is determined on 10 gauge sawdust and substrates such as wood chip will be first splintered using pruning shears to about 1 cm. and then ground using a Thomas-Wiley Intermediate Mill with a 10 gauge wire mesh screen, with intermediate dryings at 60° C. as indicated in A), above. Brightness is measured on a Photovolt Reflection meter model 670. The meter is a separate unit from the photocell and the photocell can be turned upside down if desired. Using the above instrument, the procedure is as follows:

1. Calibrate the reflection meter with an enamel plaque calibrated in terms of paper brightness (75.0). Place the plaque on a petri dish and present it to the search unit (photocell). Adjust the meter reading to the value on the enamel plaque. The standard reading may be set this way or by placing the standard inside the petri dish so it is flush with the plastic. It is separated from the dish by any distance.
2. Fill the petri dish with an even layer of sawdust, about 10 g or less, and present the dish to the search unit and take five readings from various regions of the dish. The average of the five readings is the brightness of the sawdust. A new petri dish is used for each sample and each replication.

C) Growth or virulence of a fungus will be measured for comparison among fungi and all possible conditions, unless otherwise specified, will again be made as identical as possible for the comparison. Growth or virulence is determined by a relatively simple visual observation protocol applied on a consistent basis, and carried out immediately at the end of the 10 day test period. The protocol is based on color categories of growth which can be observed or ascertained on each individual wood chip or substrate with the unaided eye at normal reading distance. One color category, typically the lightest, will represent the growth color of the ascospore candidate or lightest growing candidate if several are to be compared with each other. Categories of white (w.), gray (g.) and black (b.) may be used as well as the five categories of white (w.), light gray (l.g.), medium gray (g.), dark gray (d.g.) and black (b.) depending largely on the color of ascospore candidate to be compared with its referenced parent fungus or the number of such candidates. The five color rating category is preferred as all candidates can be usually assigned into one of the five. The number of chips observed to have the color growth of the ascospore candidate is totalled in essentially four categories as used in the evaluations reported hereinbelow, viz. a single plus (+) is assigned when about 25% of the chips show growth of the particular ascospore candidate, two pluses (++) when about 50% show growth, three pluses (+++) when about 75% show growth and four pluses (++++) when about 100% show growth. If a percentage within about 5% points of an intermediate percentage, eg. 58% is within 5% points of 62.5%, a plus is added after a slash mark and the lower rating, eg. (++/+) or by (++/+++). In an analogous manner an intermediate rating below the first level rating is indicated by (±). A similar totalling will be made for the parent(s) to be referenced. For purposes of making more precise evaluations relative to the criteria described herein, when needed, an actual percentage will be determined and the percentages compared. However, a margin of error will be allowed for human error, the greater difficulty of ascertaining lighter growths and the substantial achievement of the objectives of the invention. Such margin is 10 percentage points, such that an ascospore candidate found growing on say 78% of wood chips will be considered of equal growth ability or virulence as a parent fungus which gives a percentage of 88%. Non-sterile, treated chips will usually show growth in other areas of the chip of other organisms, commonly black coloring fungi, and such background growth coloring may be separately recorded. Such background growth does not change the evaluation being made but does indicate the presence of fungi which have naturally infested the pulpwood.

Deposits

We have deposited with the Northern Regional Research Center (NRRL) at Peoria, Ill., U.S.A. the following fungi referred to herein, which were assigned the Accession Numbers given below along with their date of deposit.

| Fungi | Accession No. | Deposit Date |
|---|---|---|
| C-1D5 (*O. piliferum*) | NRRL 18677 | July 17, 1990 |
| C-1D84 (*O. piliferum*) | NRRL 18678 | July 17, 1990 |
| C-1 (*O. piliferum*) | NRRL 18691 | July 27, 1990 |
| TAB 28 (*O. piliferum*) | NRRL 18690 | July 23, 1990 |

The deposits were made under the Budapest Treaty for this application. However, the NRRL were instructed to make generally available to the public, upon deposit, the fungi C-1 and TAB 28.

General Experimental

The following Examples 1–18 are given only for purposes of illustration and to demonstrate of the ability of the fungi of the invention to reduce wood pitch, and to demonstrate other factors bearing on the production and use of such fungi.

In the following Examples 1–18, unless otherwise indicated, pitch was quantified by a modification of TAPPI Procedure T204 OS-76 as follows: Wood chips were splintered using pruning shears to a width of about 1 cm. The resulting splinters were oven dried overnight at about 60° C.

and then ground into sawdust using a Thomas-Wiley Intermediate Mill with a 20-mesh screen. Four grams of the dried sawdust were combined with about 20 ml methylene chloride (dichloromethane-DCM) and the resulting mixture was agitated overnight at room temperature to remove extractables from the sawdust. The liquid was then pipetted from the mixture and filtered through a 0.45 micron organic filter. The recovered liquid was then evaporated at room temperature for about 15 hours (overnight) and the residue then placed in an oven at about 60° C. for 30 minutes to further remove methylene chloride. The weight of the remaining sample was then taken.

Pitch content was obtained by weighing the residue after methylene chloride removal and expressing the result as mg. of pitch content per gram of substrate which had been extracted with the methylene chloride.

In the following Examples 1–18, unless otherwise specified, the wood chips employed were made from southern yellow pine harvested in the state of Virginia, U.S.A., using a mixture of two-thirds freshly cut timber and one-third timber which had been field aged for about three months.

In the following examples, F1 is the fungus species *Ophiostoma piceae*, G1 is the fungus species *Ceratocystis adiposa* and I1 is the fungus species *Ophiostoma piliferum*, each isolated from selected samples of the above-identified southern yellow pine wood chips which were found at a pulp and paper company plant in Virginia, and produced from and used in the following examples as biologically pure cultures.

In the following examples which involve laboratory experiments, the inoculated chips and control chips were contained in sealed plastic bags during the treament (fungal growth) periods. In such experiments chips obtained from a paper mill were frozen at minus 20° C. until used. Frozen controls were maintained at minus 20° C. and room temperature controls at 20°–25° C.

EXAMPLE 1

200 gram samples of non-sterile winter wood chips were inoculated with the below-indicated three fungal cultures prepared on solid malt agar plates. The inoculated chips were then incubated at room temperature for a period of three weeks. The pitch contents compared with that of a frozen control are given below.

| Sample | Amount of Pitch mg Pitch/g Substrate |
|---|---|
| Frozen control | 32.3 |
| F1 | 21.9 |
| G1 | 19.9 |
| I1 | 13.7 |

EXAMPLE 2

300 gram samples of summer wood chips (October pile) were autoclaved prior to inoculation with the fungi noted below with spore number in the inoculum given in parenthesis. Chips (which still contain some knots) were wet with 10 mls water/100 g wood chips in an attempt to increase growth of fungus. Chip samples were incubated under these conditions for 11 and 27 days at room temperature and pitch content measured. The results compared to a frozen and unfrozen controls are given below.

| Sample | Pitch levels (mg pitch/g substrate) (11 days) | Pitch levels (mg pitch/g substrate) (27 days) |
|---|---|---|
| Frozen control | 28.2 | 32.3 |
| Control | 29.4 | 24.7 |
| F1 ($1.5 \times 10^7$) | 23.8 | 23.6 |
| G1 ($1 \times 10^7$) | 24.9 | 16.4 |
| I1 ($1.2 \times 10^7$) | 20.9 | 19.8 |
| G1 and I1 | 21.8 | 20.1 |

EXAMPLE 3

200 gram samples of non-sterile wood chips were incubated for 2 weeks at temperature. 150 g portions of each sample were used to evaluate pitch content. The results compared with a frozen control are given below.

| Sample | Pitch Level (mg pitch/g substrate) (14 days) |
|---|---|
| Frozen control | 25.4 |
| F1 | 16.4 |
| G1 | 18.6 |
| I1 | 15.3 |

EXAMPLE 4

Culturing of I1 Fungus in a Liquid Medium

The rate of spore production in liquid medium of the fungus I1 was determined. I1 was grown in a rotating (200 RPM) 2-liter flask containing 500 ml liquid basal malt extract at 25° C. The inoculum comprised 5 mm agar plugs containing sporulating fungi. Spore concentration compared with hours of growth was measured.

| Hours incubation | Spore count (spores/ml) |
|---|---|
| 48 | $8.7 \times 10^7$ |
| 72 | $3 \times 10^8$ |
| 96 | $5 \times 10^8$ |

After the 48th hour of incubation, spore viability was determined using the dilution plate assay and found to be $11 \times 10^7$ colony forming units/ml.

Such a culture prepared in liquid media may be centrifuged to remove water, and a stabilizer such as 10% dry milk solids added, to form a concentrate inoculum which can be diluted with water to provide a very effective inoculum for wood chips, sawdust and the like.

EXAMPLE 5

An outdoor experiment using 12 ton wood chip piles constructed on platforms was conducted at a site in southern Virginia, U.S.A., in early December.

The wood chips comprised approximately 60% fresh-cut wood and 40% chips from logs stored outdoors at the site for at least 3 months. Measurements by TAPPI Procedure T204 OS-76 indicated that the wood chips had a pitch content of 3.4%.

A concentrated inoculum of the I1 fungus was diluted with water to contain approximately $3 \times 10^{12}$ spores in 10 liters disilled water, thus providing approximately $2\times10^8$ spores per kilogram of chips. This inoculum was intermittently sprayed on loads of chips used in forming the pile designated Pile II, below, and onto the pile after the pile was formed. This pile was tarped with a clear plastic and heated from beneath the pile by heated forced air with the objective of providing a temperature of 70°–75° F. in most sections of the pile. The forced air heater was within a structure with cinder block sides and wire mesh screen top which separated the chips from the heater. Temperatures were monitored and many sections were about 70°–75° F.

The pile designated Pile I was tarped but unheated (and not inoculated) and temperature sensors indicated temperatures in this pile in the range of 20°–50° F.

15 days after the chip piles were constructed and tarped, chips were randomly taken from each of the thus-maintained piles and 300 pounds of samples from each pile were made into thermomechanical pulp (TMP).

The pitch content of the resulting TMP samples was evaluated by measuring the levels of extractables in the pulp by the TAPPI procedure T204-OS76. The results compared to TMP the fresh chips used in constructing the piles are set out below:

| Pile or Sample | DCM Value - extractable pitch |
|---|---|
| Fresh Sample | 3.4% |
| Pile I - (unheated tarped) | 2.7% |
| Pile I1 - (I inoculated, heated, tarped) | 2.1% |

Evaluation of other properties of the pulp and hand sheets (paper) made therefrom indicated good overall properties including better strength properties in at least one standard strength measurement compared to uninoculated samples, eg. in burst factor, tear factor, breaking length and stretch.

EXAMPLE 6

October chips (obtained from a southern Virginia paper mill) were stored for 1 week at 4° C. prior to inoculation with fungus. 400 gram samples were inoculated with the fungi indicated below with a total of about $10^7$ spores involved in each inoculation. Water was added at 15 mls/100 g chips to certain samples to determine the influence of water on the results which are given below.

| | Pitch level | |
|---|---|---|
| Sample | mg Pitch/gram substrate (17 days) | mg Pitch/gram substrate (25 days) |
| Frozen control | — | 35.4 |
| Frozen control + water | 33.8 | 29.8 |
| F1 | 23.0 | 19.4 |
| F1 + water | 22.7 | 21.4 |
| G1 | 20.7 | 15.8 |
| G1 + water | 34.2 | 27.6 |
| I1 | 23.2 | 20.4 |
| I1 + water | 25.7 | 17.8 |
| I1 + G1 | 16.7 | 15.7 |
| I1 + G1 + water | 30.4 | 18.9 |

The weight of the chips after 25 days incubation was also determined. There was little water loss during the shelf incubation.

The greatest pitch reduction in the shorter time period in these samples was observed when I1 and G1 were coinoculated onto the chips.

EXAMPLE 7

The effect of various inoculum sizes on pitch reduction was determined.

October chips were stored frozen prior to inoculation with spores of the fungus I1 grown on liquid medium.

| Strain | # Spores/ml | mg Pitch/g sawdust (21 days) |
|---|---|---|
| Frozen control | | 24.4 |
| I1 | $6\times10^4$ | 17.8 |
| I1 | $6\times10^5$ | 14.7 |
| I1 | $6\times10^6$ | 15.1 |
| I1 | $6\times10^7$ | 16.7 |
| I1 | $6\times10^8$ | 21.8 |
| I1 | $1\times10^9$ | 19.3 |

Results above indicate the potential of inoculation concentration on the wood chips to influence pitch reduction.

EXAMPLE 8

65 g samples of splintered chips (autumn pile, stored frozen) and 5 mls water were autoclaved for 40 min., allowed to cool and inoculated with the fungi indicated below, and the samples maintained for 21 days at room temperature. Results compared to controls are given below.

| Strain | # Spores/ml | mg pitch/g sawdust (21 days) |
|---|---|---|
| Frozen control | | 34.4 |
| Room temp control | | 32.7 |
| I1 | $96\times10^7$ | 20.9 |
| G1 | $1\times10^7$ | 26.7 |
| F1 | $5\times10^7$ | 23.9 |
| C1 | $1.5\times10^7$ | 21.9 |
| E1 | $8.6\times10^7$ | 24.9 |

The fungus C1 and E1, above, are blue-stains isolated from wood chip in southern Virginia. The fungus C1 was identified as another isolate of *O. piliferum* and the fungus E1 was identified as a species of Graphium (ie. Graphium sp.).

EXAMPLE 9

Fungal Growth in Liquid Culture—Spore Stability Testing

The fungus I1 was grown for 6 days in a standard liquid malt extract medium, the cultures centrifuged, and the pellet resuspended in fresh malt extract resulting in a 25-fold concentration. Spore viability was assayed after storage for 2 weeks at various temperatures by dilution plate analysis on malt extract agar. Results are below.

| Storage conditions | Colony forming units/ml |
|---|---|
| time 0 | $1\times10^{10}$ |
| −20° C. | $4\times10^9$ |
| −20° C. | $3\times10^9$ |
| 4° C. | $6\times10^8$ |

-continued

| Storage conditions | Colony forming units/ml |
|---|---|
| 25° C. | less than $10^3$ |
| 37° C. | less than $10^3$ |

In a second experiment, a 5 day old culture of I1 was centrifuged, frozen at −20° C., and lyophillized. Spore viability was assayed after storage for 1 week at various temperatures by dilution plate analysis on malt extract agar. Results are below.

| Storage conditions | Colony forming units/ml |
|---|---|
| time 0 | $5 \times 10^9$ |
| −20° C. as frozen pellet | $3 \times 10^8$ |
| −20° C., lyophillized | $7 \times 10^7$ |
| 4° C., lyophillized | $8 \times 10^7$ |
| 25° C., lyophillized | $6 \times 10^7$ |

Liquid I1 cultures were harvested by centrifugation and resuspended in a minimum volume of skim milk. Spores were stored for two weeks and results are indicated below.

| Storage conditions | Colony forming units/ml |
|---|---|
| time 0 | $3 \times 10^9$ |
| −20° C. in malt extract | $2 \times 10^8$ |
| −20° C. as frozen pellet | $3 \times 10^8$ |
| −20° C. in skim milk | $7 \times 10^9$ |
| −20° C., milk, lyophillized | $2 \times 10^9$ |

Thus, spores may be stored either frozen at −20° C. or lyophillized with no loss in viability.

EXAMPLE 10

Fermentation Trial of Fungus I1

A 10 liter fermentation growth of I1 was conducted in a 201 Chemap fermentor. The medium consisted of 20 g malt extract (Difco) and 2 g yeast extract per liter. The pH of the medium after autoclaving was 5.9. The inoculum consisted of 100 mls of growth medium containing $3\times10^8$ spores/ml. The fermentation was conducted at a temperature of 25.1° C., with agitation at 600 rpm, and aeration at 9.41/min. The pH was not controlled during the incubation. Foaming was controlled with 20% antifoam B emulsion (Sigma, diluted to 20% strength). pH, dissolved $O_2$, and temperature were measured during the run. Samples were removed periodically for subsequent analysis of cell number.

| Hours fermentation | # Spores/ml | pH | $O_2$* | Temperature |
|---|---|---|---|---|
| 0 time | 1 × 7 × 106 | 5.8 | 54 | 25.1 |
| 4.5 | 4.4 × 106 | 5.9 | 54 | 25.1 |
| 9 | | | 50 | |
| 11 | | 5.8 | | |
| 14 | | 5.2 | 38 | |
| 19.0 | 9.5 × 106 | 4.6 | 34 | 25.1 |
| 23.5 | 3.2 × 107 | 4.4 | 34 | 25.1 |
| 28.5 | 7.2 × 107 | 4.8 | 34 | 25.1 |
| 32 | | 5.6 | | |
| 43.5 | 2.3 × 108 | 4.6 | 34 | 25.1 |
| 51 | 2.5 × 108 | 4.3 | 34 | 25.1 |
| 70 | 3.5 × 108 | 4.2 | 36 | 25.1 |

*Oxygen levels reported as % saturation.

Examination of the samples under a microscope revealed a higher percentage of hyphae than observed in shake flasks, especially during the early time points. Not until 44 hours did the yeast-like forms predominate. The increased aeration during the fermentation may have caused the alteration in growth morphology. Either a lower rate of aeration or a larger inoculum may force the fungus into the yeast-like state earlier in the incubation. The yeast-like growth may be preferred because of higher viability in preservation studies.

EXAMPLE 11

Southern yellow pine wood chips which were about 1–2 weeks old were individually selected from a wood chip pile in South Carolina on the basis of indicating a presence of blue stain fungi on the chips. Individual fungal isolates were obtained from the chips, grown up as biologically pure cultures and the fungi identified. An inoculum of each such culture after about 48 hours growth and each containing about $1\times10^8$ spores/ml. was used to inoculate sterilized Southern yellow pine wood chips which were then maintained in plastic bags for two weeks and then analyzed for pitch content versus a similarly maintained but untreated control. The individual fungal isolates (assigned a TAB No.) and the results are reported below.

| Fungus/Sample | Fungus Identification | Pitch Level (%) |
|---|---|---|
| Room Temp. Control | | 2.0 |
| TAB 19 | Pyrenomycete sp | 1.7 |
| TAB 20 | Pyrenomycete sp | 1.7 |
| TAB 21 | Pyrenomycete sp | 1.6 |
| TAB 23 | *Ophiostoma piliferum* | 1.5 |
| TAB 25 | *Ophiostoma piliferum* | 1.6 |
| TAB 26 | *Ophiostoma piliferum* | 1.4 |
| TAB 28 | *Ophiostoma piliferum* | 1.5 |
| TAB 27 | *Ophiostoma ips* | 1.4 |

In the foregoing, the Pyrenomycete sp. (a preferred subclass) were Blue Stain fungi and TAB 23 was judged a faded variant of *Ophiostoma piliferum.*

EXAMPLE 12

From two different 5 day old cultures of the fungus I1 (*Ophiostoma piliferum*), after agar plating for serial dilution count, essentially light gray spots were observed and these spots were picked from the plated cultures and grown up as individual isolates. Each was found to be a faded variant of *Ophiostoma piliferum* and the two isolates were given the identification SP1 and SP70, respectively. Each grew substantially white on sterilized southern yellow pine.

EXAMPLE 13

Experiments similar to those in Example 11, above, were conducted with various fungi herein identified and the brightness of the treated chips was determined by a standard measurement to determine the effect of the fungi on color value of the treated chips. The results are reported below.

| Fungus/Sample | Pitch level (%) | Brightness |
|---|---|---|
| Frozen control | 2.3 | 39 |
| Room temp control | 2.2 | 39 |
| C1 - *Ophiostoma pilifera* | 1.5 | 34 |
| TAB 23 - *Ophiostoma piliferum* | 1.5 | 38 |
| TAB 28 - *Ophiostoma piliferum* | 1.5 | 28 |
| CMW 3 - *Leptographium procerum* | 1.5 | 41 |
| CMW 68 - *C. fraxinopennsylvanica* | 1.7 | 40 |

-continued

| Fungus/Sample | Pitch level (%) | Brightness |
|---|---|---|
| CMW 69 - *O. piceae* | 1.6 | 36.4 |
| CMW 72 - *O. tremuloaurea* | 1.7 | 38 |
| CMW 77 - *O. populinum* | 1.6 | 39 |
| CMW 108 - *O. pluriannulatum* | 1.7 | 38 |
| CMW 135 - *O. adjuncti* | 1.4 | 35 |
| CMW 160 - *O. tetopii* | 1.7 | 33.5 |
| SP1 - *Ophiostoma piliferum* | 1.6 | 35 |
| SP70 - *Ophiostoma piliferum* | 1.5 | 41 |
| *Ophiostoma nigrocarpum* | 1.8 | (control 2.1) |

EXAMPLE 14

100 g of non-sterile southern yellow pine woodchips are inoculated with $10^6$ blastospores of a light gray growing faded variant of I1 that was also picked from a culture of I1. The chips are incubated for 2 weeks at room temperature. Pitch content is given below.

| Samples | Pitch content |
|---|---|
| Non-inoculated control | 2.3% |
| Faded I1 inoculated | 1.9% |

EXAMPLE 15

Fermentation of *Ophiostoma piliferum*

Master stocks of *Ophiostoma piliferum* TAB 28 cells were routinely stored in 2 ml ampules containing $3\times10^8$ cells. A frozen vial of cells was thawed and diluted into 1 liter of YM media (20 g/L malt extract and 2 g/l yeast extract). Four days later this media contained approximately $5\times10^8$ cells/ml and was used as the inoculum for 15 liters of YM media in a 20 liter fermentor. The fermentation was conducted at a temperature of 25° C., agitation rate of 300 rpm, and aeration at 5 liters per minute. The pH was not controlled during the fermentation. Foaming was controlled with 20% Antifoam B emulsion (Sigma Chemical Co.). Forty hours later this media contained $1\times10^8$ cells/ml and all 15 liters of media were used as the inoculum for 250 liters of media in a 300 liter fermentor. Fermentation and growth parameters are tabulated below.

TABLE

Growth conditions for 250 liter fermentation.

| Timepoint | Cells/ml | pH | Dissolved $O_2$ % | Temperature |
|---|---|---|---|---|
| 0 | $6 \times 10^6$ | 5.9 | 97 | 25° C. |
| 10 hours | $6 \times 10^6$ | 5.9 | 97 | 25° C. |
| 20 hours | $1 \times 10^8$ | 4.5 | 63 | 25° C. |
| 30 hours | $5 \times 10^8$ | 4.4 | 50 | 25° C. |
| 40 hours | $2 \times 10^9$ | 4.2 | 50 | 25° C. |

Fungal biomass is harvested after 40 hours of fermentation by centrifugation, resuspended in water at conc. of $5\times10^9$ cell/ml. and stored at 5° C.

EXAMPLE 16

A two liter Erylenmeyer flask containing 750 ml of 2% malt 0.2% yeast extract was sterilized, cooled and inoculated with plus of TAB 28 grown on malt yeast agar slants. The pH of the medium after sterilizing was 5.9. The culture was agitated at 160 rpms at 25° C. for 36 hours then harvested. Samples were removed periodically for subsequent analysis of cell number, indicated below.

| Hours of Growth | Blastospores/ml |
|---|---|
| 15 | $3 \times 10^5$ |
| 24 | $1 \times 10^8$ |
| 30 | $1.9 \times 10^8$ |
| 36 | $1.2 \times 10^8$ |

Examination under the light microscope revealed primarily mycelia with long hyphac at 18 hours and by 36 hours yeast-like cells predominated (containing about 5% mycelia).

EXAMPLE 17

100 g non-sterile southern yellow pine woodchips in plastic bags were inoculated with $10^8$ blastospores of TAB 28 previously grown in shake cultures for 36 hours. The chips were incubated for 2 weeks at room temperature. Pitch content was measured and is given below.

| Sample | % DCM Extractives |
|---|---|
| Time 0 control | 2.3 |
| Non-inoculated control | 2.0 |
| TAB 28 inoculated | 1.7 |

EXAMPLE 18

An outdoor experiment involving two chip piles of 2.5 tons each, is carried out in South Carolina, USA in early August. The woodchips are made from freshly cut southern yellow pine and the piles are constructed on plastic sheets.

The fungal inoculum consists of yeast-like cells of *Ophiostoma piliferum* TAB 28 (dark blue strain) grown for 5 days in liquid culture (2% malt, 0.2% yeast and 750 ml volume in 2 liter flask) at 25° C. and subsequently stored in 10% skim milk at −20° C. The inoculum is sprayed onto the chips as the pile is accumulating so that 1 Kg woodchips is inoculated with $10^8$ viable fungal cells. Only one pile is treated, the other one serving as control.

Four weeks after inoculation chip samples are randomly taken from each pile. The pitch content of each sample is measured and the average amount is calculated for each pile. The results are given in the table below.

| Pile | Average Pitch Content |
|---|---|
| Control pile | 2.1% |
| Inoculated pile | 1.6% |

The microbial population of each pile is also investigated. Chips randomly taken from the piles are individually placed on solid culture medium (malt and yeast extract agar) and the microbial population growing therefrom is analysed. Results are to be seen below.

| Pile | Blue Stain | Bacteria | Other Fungi |
|---|---|---|---|
| Control pile | 20%* | 100% | 35% |
| Inoculated pile | 90% | 95% | 30% |

*percentage of the infected chips

Ascospore Experimental

The following experiments are illustrative of the generation, isolation, selection and use of ascospore fungi.

Pitch reduction, brightness and virulence were determined essentially as described above under the heading Evaluation Procedures For Ascospores.

In the description below, we employ the fungus we called C-1, a faded (dark gray) isolate of *O. piliferum* obtained from a pulpwood in the State of Virginia, U.S.A. The strain C-1, unlike a number of our *O. piliferum* isolates, is self-fertile. Hence, it was a time-saving candidate as mating could be avoided.

Ascospores of *O. piliferum* are produced in specialized reproductive structures called perithecia. The ascospores are produced in asci within the base of perithecium. As the ascospores mature, the asci autodeliquess and the ascospores are secreted in a droplet of viscous hydrophobic material at the top of the perithecium. Isolation of the ascospores may be effected with pinene as recommended in the literature. However, it was found that a sterile vegetable oil/detergent treatment produced a very high degree of the desired dispersal of the ascospores and was non-toxic. In fact, the vegetable oil is consumed by the fungus as an apparent food (carbon source) in a manner judged analogous to the consumption of pitch, and hence the method may be applied to any fungus which consumes pitch.

C-1 was grown on sterile wood for 2–4 weeks to allow for the production of perithecia. Then ascospore drops were picked with a sterile dissection needle and transferred to 400 ul corn oil. The sample was vortexed to form a uniform spore suspension. This suspension was examined in a hemocytometer counting chamber under a microscope and found to contain $1\times10^6$ cells/ml, of which 90–95% were single ascospores. The remaining 5–10% of the fungi consisted of hyphal fragments and clumped ascospores.

The ascospores were diluted 100 fold in sterile corn oil, then two separate additional dilutions, 10 and 100 fold in sterile 10% Triton X100 were made for comparison to each other. 100 ul aliquots of the two dilutions were plated on YMA to achieve plating densities of 100 and 10 spores per plate. Triton X100 was used to disperse the corn oil and prevent reaggregation of the oil droplets on the surface of the agar. TRITON® X-100 is nontoxic to this fungus in liquid culture, but because it was not known how entrapment of spores in oil/detergent micells would effect their germination, a set of dilutions were made without detergent and plated for comparison.

The fungus removed the oil from the plates as it grew. On those plates where spores were plated without detergent, colonies floated on top of the oil and tended to clump. In the presence of oil/detergent, colonies remained discrete and quite compact, but were slower to achieve pickable size. Oil colonies were large enough to pick in 4 days, while oil/detergent colonies were ready in 7 days.

There was no toxicity or prevention of germination observed using the oil/detergent method. The lower viability observed in the absence of detergent may be caused by aggregation of colonies or germinating spores on the oil surface, see table below.

| | Colonies per plate | | |
|---|---|---|---|
| Method | $10^3$ dilution | $10^4$ dilution | % Viability |
| oil | 29,25,14,22,17,29 | 2,9,3,1,2 | 23% |
| oil/detergent | 103,102,105,104, 82,119 | 10,5,10,12,8, 8,9,14,10,9 | 100% |

When the individual colonies were large enough to restreak, all of the colonies from the lower dilution plates, regardless of size or coloration, were transferred to fresh YMA for storage and testing for perithecia production (homokaryon status).

Isolation of Viable Colonies with Corn Oil/Detergent

| age of plate | Cells/ml | % single | % viable |
|---|---|---|---|
| 1 week | $45\times10^4$ | 75% | <limit of detection |
| 3 weeks | $28\times10^5$ | 98% | 70% |
| 4 weeks | $33\times10^5$ | 96% | 69% |

Cells/ml refers to the number of cells in the suspension of 10 ascospore drops picked for the experiment.

Screening for Homokaryons and Preliminary Selection

The C-1 ascospore isolates were screened in order to eliminate as many heterokaryons as possible and to determine the efficacy of the oil/detergent isolation as a method of producing homokaryons. Production of mature perithecia containing ascospores requires two complementary mating types that homokaryotic strains can not possess; heterokaryotic strains may possess both factors (i.e. be self-fertile). Although a homokaryon may produce an immature perithecium, called a protoperithecium, only a heterokaryon may produce a mature perithecium. Thus, heterokaryotic strains can be detected by virtue of perithecium production, but the absence of perithecia formation does not prove a strain to be homokaryotic.

Screening was carried out by streaking each isolate on wood chip agar and monitoring for perithecium production over a 2 month period.

Only 9 out of 105 C-1 isolates screened produced perithecia and were discarded. The following table presents a numeric breakdown of the remaining C-1 isolates that do not produce perithecia and are presumed to be homokaryotic. The isolates were grouped according to the color of growth on wood chip agar.

| | Numeric Breakdown of C-1 Isolates | |
|---|---|---|
| Group Color | Number of Isolates | % of Total |
| black | 29 | 30% |
| grey | 60 | 63% |
| light | 7 | 7% |

The 96 presumed homokaryons obtained from C-1 showed good coverage on wood chip agar. All of the lighter C-1 isolates (and others) were preliminarily screened for growth rate on nonsterile and sterile wood chips in order to select the more virulent of these isolates for further studies.

Growth Screening of More Virulent Light Group Canidates

Each of the more virulent candidate fungi was cultured in YM at room temperature, 200 rpm for 72 hours (72 hours was chosen due to slow grow rate of some strains). Cells were harvested by centrifugation and resuspended in sterile water to a viable CFU concentration of approximately $1\times10^8$/ml.

100 g samples of sterile (autoclaved) and nonsterile (less than 1 week old chips stored at 5° C. prior to use) southern yellow pine chips were inoculated in duplicate with 1 ml of fungal suspension.

The inoculated chips were stored at room temperature in the dark. Growth was monitored with time over a period of ten days.

In the table below, only the evaluation of the five better growing isolates in the light color group are reported (the evaluation procedure being as described above under Evaluation Procedures For Ascospores).

Growth of C1 Light Isolates.

| | fresh chips | | | | |
|---|---|---|---|---|---|
| Fungus | 1 day | 3 days | 5 days | 7 days | 10 days |
| control | — | — | +/− | +d.g. | +++d.g. |
| C1 parental | — | — | +l.g. | ++l.g. | +++g. |
| C1 oil 6 | — | — | +/− | +l.g. | ++/+++g. |
| C1 det 5 | — | — | +w. | ++w. | +++/++++l.g. |
| C1 det 23 | — | — | +/− | ++g. | ++/+++g. |
| C1 det 41 | — | — | +/− | ++l.g. | +++g. |
| C1 det 84 | — | — | +w. | +w | +++w |
| TAB28 | — | — | +++d.g. | ++++d.g. | ++++b. |

| | sterile chips | | | | |
|---|---|---|---|---|---|
| Fungus | 1 day | 3 days | 5 days | 7 days | 10 days |
| control | — | — | — | — | — |
| C1 parental | — | +/− 1 | +++l.g. | ++++l.g. | ++++g. |
| C1 oil 6 | — | +/− w | + | +++l.g. | ++++l.g. |
| C1 det 5 | — | ++w. | +++w. | ++++l.g. | ++++l.g. |
| C1 det 23 | — | +/− w. | ++w. | +++g. | ++++l.g. |
| C1 det 41 | — | +/− l. | ++l.g. | +++/++++l.g. | ++++l.g. |
| C1 det 84 | — | + w | ++w | +++/++++w. | +++/++++w. |
| TAB28 | — | ++d.g. | ++++d.g. | ++++b. | ++++b. |

The above homokaryons isolates indicated a range of virulence, with at least C1 det 5 and C1 det 84 indicated to meet our criteria.

Pitch Reduction and Brightness Effects

Fungi was cultured in YM at room temperature, 200 rpm for 72 hours. Cells (about 95% blastospores/5% mycelia) were harvested by centrifugation and resuspended in sterile water to approximately a viable CFU of $1\times10^8$/ml. Five replicate 100 g bags of sterile southern yellow were inoculated with 1.0 ml of fungal suspension. The inoculated and control bags were incubated at room temperature in the dark for three weeks. Four replicates from each set of five were analyzed for pitch content. The fifth was measured for brightness. Results are given in the table below, and include results for fungi from the black and grey groups as well as the two desired (selected) isolates in the light group.

| Sample | Color of growth on wood | % Extractives | Brightness |
|---|---|---|---|
| Control | not applicable | 1.81 | 49.5 |
| C-1 parental | gray | 0.90 | 38.3 |
| C-1 det 69 (Gray Group) | gray | 1.15 | 41.2 |
| C-1 det 2 (Gray Group) | gray | 0.83 | 44.7 |
| C-1 det 5 | light gray | 0.88 | 46.8 |
| C-1 det 84 | white | 1.38 | 51.9 |
| C-1 det 90 (Black Group) | black | 1.49 | 24.0 |

All the above tested strains showed significant pitch reduction. The degree of brightness loss depended upon the color of growth of the fungus on wood. The two light strains tested C-1 det 5 (C-1D5) and C-1 det 84 (C-1D84) showed considerably better brightness than the parent C-1 fungus. The C-1D84 desirably was indicated to have better brightness than the untreated control.

Field Evaluations

Selected light ascospore isolates were tested for growth under field conditions (non-sterile wood chips) along with selected isolates from the gray group.

Fungal strains were inoculated with a hand-held sprayer on non-sterile wood chips prepared from 2 day old logs to form 10 ton piles. The non-sterile chips were obtained from an area in which a native *O. piliferum* blue stain had been tolerated and were selected on the basis of being naturally infested with such blue stain. The piles were incubated outside under ambient conditions, for two weeks. The piles were then dismantled and the amount of fungal growth was recorded.

The table below summarizes the results of this field trial comparing faded strains inoculated with a hand held spryer.

| | Dose | Average growth | |
|---|---|---|---|
| Treatment (Group) | CFU/kg chips | Background | Light |
| control | | ++++ | |
| TAB28 (black) | $2\times10^8$ | ++++ | |
| Cldet2 (gray) | $3\times10^8$ | ++++ | ++/+ |
| Cldet4 (gray) | $9\times10^8$ | ++++ | + |
| Cldet23 (light) | $2\times10^7$ | ++++ | + |
| Cldet23 (light) | $2\times10^8$ | ++++ | ++ |
| Cldet41 (light) | $3\times10^7$ | ++++ | + |
| Cldet4l (light) | $3\times10^8$ | ++++ | +/+ |
| Cldet72 (gray) | $4\times10^8$ | ++++ | +/+ |
| Cldet84 (white) | $4\times10^7$ | ++++ | +++ |
| Cldet84 (white) | $4\times10^8$ | ++++ | +++/+ |
| Cldet5 (light) | $5\times10^8$ | ++++ | +++ |
| Cldet5 (light) | $5\times10^9$ | ++++ | +++ |

Dosage applied is expressed as colony forming units (CFU) per kg of wood chips. Background growth is indicative of growth of black/dark colored fungi already present in the wood (or of inoculum in the case of the black strain TAB28).

In addition, C-1D5 was inoculated with an in-line sprayer on chips prepared from 3 week old logs and the results of growth in 10 ton piles after two weeksare given below (which also indicates a potential suppression of background growth by the fungus).

| | Dose | Average growth | |
|---|---|---|---|
| Treatment | CFU/kg chips | Black | Light |
| control | | +++/+ | |
| Cldet5 | $7\times10^7$ | +++ | +++ |
| Cldet5 | $4\times10^8$ | ++/+ | ++++ |

Both C-1D5 and C-1D84 showed in the field evaluations very good growth on the non-sterile chips and also a dose/response relationship.

The above results indicate, in addition to the good pitch reduction and essentially the absence negative brightness influence, that the selected isolates C1det84 and C1det5 grow very well under the highly competitive conditions which may be encountered in a wood chip pile or other pulpwood forms, and in particular produce their desired effect at inoculum dosages approaching the same order of magnitude as the highly effective TAB28. Not only are such objectives met by these two species, but the results indicate the additional and most significant advantage in the potential of such fungi to partially overcome or displace the darkening influences of fungi which naturally infect such pulpwoods, thereby resulting in a pulpwood which is essentially even lighter than a control or conventionally handled pulpwood, thus potentially allowing even a reduction in subsequent treatments used to enhance brightness as particularly applied, for example, in connection with mechanical pulps.

In-line Sprayer.

The in-line spray system for dispensing inoculum in large scale operations includes a 50 gallon tank, a motor driven propeller, and a pump. The 50 gallon tank acts as a reservoir of inoculum. A propeller inside the tank is used to provide the agitation required to keep the fungal cells in suspension. The pump withdraws the inoculum from the reservoir and dispenses the liquid at a rate of 25 gallons/30 minutes to a series of 7 nozzles connected to best effect uniform discharge from each nozzle. The nozzles are attached 3 feet above a screw type conveyor having four one foot diameter screws in paralled across a bed which is five feet wide and four feet deep. The seven nozzles are organized in staggered fashion in two rows of four and three nozzles with 1.5 feet separating the two rows. The chips are advanced at about 60 feet/minute. The inoculated chips are discharged from the belt for evaluation storage at a point four feet passed the last (3 nozzle) row.

In an additional study, the fungi TAB 28, CID5 and CID84 were evaluated on wood chips of sterilized white pine (*Pinus strobis*) obtained from State of Ohio, U.S.A. and were found after 14 days to result in a pitch content of 1.87% for TAB 28, 2.05% for CID5 and 2.15% for CID84 compared to a control of 3.4%.

In our prior U.S. application Ser. No. 310,814, certain genera were identified or assigned in a manner believed consistent with accepted taxonomic classifications. In the description herein, certain previously identified fungi and genera have been renamed or regrouped consistent with a more recent taxonomic reclassification, the basis of which is given above.

What is claimed is:

1. A process for reducing the pitch content of pulpwood or pulp without substantially degrading cellulose content comprising applying to the pulpwood or pulp a biologically pure inoculum of a wood penetrating, pitch-degrading fungus of the genus Ophiostoma, said inoculum being derived from a purified culture of said fungus and applying to the pulpwood or pulp the fungus in an amount effective for reduction of the pitch content of the pulpwood or pulp and maintaining the inoculated pulpwood or pulp under conditions which allow growth of the inoculated fungus for a time sufficient to effect a reduction of the pitch content of the pulpwood or pulp by such fungus.

2. The process of claim 1 in which unsterilized refined pulpwood is inoculated and maintained in an accumulated mass for the time sufficient to reduce its pitch content.

3. The process of claim 2 in which the pulpwood is wood chips.

4. The process of claim 1 in which the fungus is a homokaryon.

5. The process of claim 3 in which the inoculum is applied to the wood chips while the wood chips are in an agitated, tumbling state.

6. The process of claim 2 in which the fungus is a blue staining fungus.

7. The process of claim 4 in which the fungus is a blue staining fungus.

8. The process of claim 3 in which the wood chips are accumulated in a wood chip pile.

9. The process of claim 1 in which the fungus is an ascospore-derived fungus or a derivative thereof which grows substantially white in color.

10. The process of claim 8 in which the maintenance of fungal growth conditions in the wood chip pile comprises covering substantially the entire exposed surface of the pile with a sheet material.

11. The process of claim 3 in which the fungus is an ascospore-derived fungus or derivative thereof and the fungus treated wood chips have a brightness which is substantially no less than the brightness of the unsterilized wood chips maintained as an untreated control over the same period during which the fungus was allowed to grow on the treated chips.

12. The process of claim 10 in which the maintenance of fungal growth conditions in the wood chip pile additionally comprises applying heat to the wood chip pile.

13. The process of claim 11 in which the fungus grows substantially white in color.

14. The process of claim 3 in which the wood chips are provided substantially entirely from freshly cut timber.

15. The process of claim 13 in which the treated wood chips are brighter than the control chips.

16. The process of claim 3 in which the fungus naturally infects harvested wood from which the wood chips are prepared.

17. The process of claim 4 in which the fungus naturally infects harvested wood from which the wood chips are prepared.

18. The process of claim 3 in which the wood chips are pinewood wood chips.

19. The process of claim 3 in which the wood chips are pinewood wood chips.

20. A process of claim 1 in which the fungus is selected from the group consisting of *Ophiostoma picaea, Ophiostoma piliferum, Ophiostoma ips, Ophiostoma populinam, Ophiostoma pluriannulatum, Ophiostoma adjuncti, Ophiostoma tetroplii, Ophiostoma minus, Ophiostoma ulmi, Ophiostoma nigrocarpum, Ophiostoma penicillatum, Ophiostoma gossypinum, Ophiostoma europhioides, Ophiostoma aureum, Ophiostoma robustum, Ophiostoma galeiformis, Ophiostoma olivaceum, Ophiostoma distortum, Ophiostoma stenoceras, Ophiostoma clavigerum, Ophiostoma dryocoetidis, Ophiostoma huntii, Ophiostoma brevicolla, Ophiostoma abiocarpum, Ophiostoma tremuloaureum*, and *Ophiostoma microsporum.*

21. The process of claim 1 in which the fungus is *Ophiostoma piliferum.*

22. The process of claim 1 in which the fungus is *Ophiostoma piliferum* which grows substantially white in color.

23. The process of claim 1 in which the inoculum comprises at least 50% spores.

24. The process of claim 3 in which the inoculum comprises at least 80% blastospores.

25. The process of claim 1 in which the inoculum is obtained from a biologically pure culture of one or more such fungi.

26. The process of claim 3 in which the inoculum is obtained from a biologically pure culture of one or more such fungi.

27. The process of claim 1 in which pulp is treated.

28. The process of claim 27 in which the pulp is mechanical pulp.

29. The process of claim 27 in which the fungus is a homokaryon.

30. The process of claim 28 in which the mechanical pulp is first stage mechanical pulp.

31. The process of claim 27 in which the fungus is an ascospore-derived fungus which grows substantially white in color.

32. The process of claim 27 in which the fungus naturally infects harvested wood from which the pulp is obtained.

33. The process of claim 32 in which the wood is pinewood.

34. The process of claim 33 in which the fungus is selected from the group consisting of *Ophiostoma picaea, Ophiostoma piliferum, Ophiostoma ips, Ophiostoma populinam, Ophiostoma pluriannulatum, Ophiostoma adjuncti, Ophiostoma tetroplii, Ophiostoma minus, Ophiostoma ulmi, Ophiostoma nigrocarpum, Ophiostoma penicillatum, Ophiostoma gossypinum, Ophiostoma europhioides, Ophiostoma aureum, Ophiostoma robustum, Ophiostoma galeiformis, Ophiostoma olivaceum, Ophiostoma distortum, Ophiostoma stenoceras, Ophiostoma clavigerum, Ophiostoma dryocoetidis, Ophiostoma huntii, Ophiostoma brevicolla, Ophiostoma abiocarpum, Ophiostoma tremulo-aureum, Ophiostoma minutum* and *Ophiostoma microsporum.*

35. The process of claim 1 in which the pulp is mechanical pulp, the fungus is *Ophiostoma piliferum* and it naturally infects harvested wood from which the pulp is obtained.

36. The process of claim 33 in which the pulp is obtained from southern United States yellow pinewood chips.

37. The process of claim 33 in which the inoculum comprises at least 50% spores.

38. The process of claim 36 in which the inoculum is obtained from a biologically pure culture of one or more such fungi.

39. The process of claim 1 for reducing the pitch content of unrefined pulpwood comprising applying to the pulpwood an inoculum obtained from a purified culture of a wood-penetrating, pitch-degrading fungus of the fungal class Ascomycotina or Deuteromycotina and maintaining the thus treated pulpwood under conditions under which the fungus will grow and penetrate the pulpwood for a time sufficient to reduce the pitch content of said pulpwood by said fungus.

40. The process of claim 39 in which the pulpwood is scored, undebarked timber.

41. The process of claim 40 in which the timber is pinewood.

42. The process of claim 41 in which the timber is southern United States yellow pine.

43. The process of claim 42 in which the fungus is from the species selected from *Ophiostoma piliferum* and *Ophiostoma picea.*

44. The process of claim 43 in which the non-sterile pulpwood is treated.

45. The process of claim 44 in which the fungus obtainable from the ascospore is characterized by reducing the pitch content of the sterilized substrate by at least 25% after no more than 21 days without decreasing the brightness of the substrate by no more than ten percent compared to an untreated control.

46. The process of claim 44 in which the fungus obtained from the ascospore meets both of the further characterizing criteria ii) and iii) of claim 43.

47. The process of claim 43 in which the substrate used for selecting the fungus is of the same wood species to which the inoculum is applied to reduce pitch.

48. The process of claim 44 in which a parent fungus exhibits predominantly a gray color when grown on the sterilized wood substrate.

49. The method of claim 44 in which the ascospores are obtained from a single, self-fertile parent fungus.

50. The method of claim 44 in which the ascospores are obtained from two, mating parent fungi.

51. The method of claim 44 in which a parent fungus exhibits predominantly a gray color when grown on the sterilized wood substrate.

52. The method of claim 47 in which a parent fungus exhibits predominantly a gray color when grown on the sterilized wood substrate.

53. The method of claim 44 in which the ascospore is of a fungus of the species *Ophiostoma piliferum.*

54. The process of claim 1 in which the inoculum is of a fungus or the progeny of a fungus obtained from: a) an isolated ascospore of a culture of one or more wood-penetrating, pitch-degrading parent fungi of the class of Ascomycotina or Deuteromycotina, said ascospore providing a wood-penetrating, pitch-degrading fungus characterized by the criteria i) growing on a sterilized wood substrate to reduce the pitch content of the substrate by at least 20% after no more than 21 days, and further characterized by the criteria of ii) resulting in a brightness level after 14 days growth on a non-sterile substrate that is at least equal to the brightness level of an untreated, non-sterile control substrate after 14 days, said substrate embodying such natural infection by organisms that the brightness level of said untreated, non-sterile control substrate is reduced by at least 10% when compared after 14 days with the brightness of an untreated, sterilized control substrate, the evaluation dosage not exceeding $10^{10}$ CFU per kilogram; or b) a biologically pure culture of a derivative of the fungus obtainable from the ascospore fungus.

55. The process of claim 54 in which the ascospore fungus results in a brightness level on the treated non-sterile substrate that exceeds the brightness level of the untreated, non-sterile control substrate.

56. The process of claim 55 in which the inoculum is obtained from a biologically pure culture of the ascospore fungus.

57. The process of claim 54 in which the ascospore fungus is of the species *O. piliferum.*

58. The process of claim 54 in which the brightness level of the untreated, non-sterile control is reduced by at least 20% compared to the untreated, sterilized control.

59. The process of claim 54 in which the ascospore fungus grow substantially white in color on a sterilized substrate after 14 days growth.

60. The process of claim 54 in which the wood substrate on which criteria are satisfied is of the same wood species as the pulpwood or pulp being inoculated to reduce its pitch content.

61. The process of claim 54 in which the substrate on which criteria are satisfied and the pulpwood or pulp being inoculated to reduce its pitch content are each of pinewood.

62. The process of claim 61 in which the fungus is species *O. piliferum.*

63. The process of claim 62 in which the pinewood is southern (United States) yellow pine.

64. The process of claim 2 in which the pulpwood is pinewood and in which fungus is a homokaryotic fungus having on the inoculated pulpwood at least the characteristics for pitch-degradation, growth and brightness effects which are possessed on such pulpwood by the fungus of NRRL Accession No. 18677.

65. The process of claim 64 in which the fungus species is *Ophiostoma piliferum.*

66. The process of claim 65 in which the fungus is the fungus of NRRL Accession No. 18677, or the progeny thereof.

67. The process of claim 1 in which the pulpwood is pinewood and is which the fungus is a homokaryotic fungus having at least the characteristics for pitch-degradation, growth and brightness effects which are possessed on the pulpwood by the fungus of NRRL Accession No. 18678.

68. The process of claim 67 in which the fungus species is *Ophiostoma piliferum.*

69. The process of claim 68 in which the fungus is the fungus of NRRL Accession No. 18678 or the progeny thereof.

* * * * *